US009534390B2

(12) United States Patent
Pendley et al.

(10) Patent No.: US 9,534,390 B2
(45) Date of Patent: Jan. 3, 2017

(54) SUPPORT STRUCTURES ON ROOFS

(71) Applicants: Timothy Pendley, Madera, CA (US); Michael J. McLain, Green Bay, WI (US)

(72) Inventors: Timothy Pendley, Madera, CA (US); Michael J. McLain, Green Bay, WI (US)

(73) Assignee: T&M Inventions, LLC, Green Bay, WI (US)

( * ) Notice: Subject to any disclaimer, the term of this patent is extended or adjusted under 35 U.S.C. 154(b) by 0 days.

(21) Appl. No.: 13/839,418

(22) Filed: Mar. 15, 2013

(65) Prior Publication Data

US 2014/0260068 A1 Sep. 18, 2014

(51) Int. Cl.
*E04D 13/03* (2006.01)
*E04D 3/367* (2006.01)

(52) U.S. Cl.
CPC ..... *E04D 13/031* (2013.01); *E04D 3/364* (2013.01); *E04D 13/0315* (2013.01)

(58) Field of Classification Search
CPC ..... E04D 3/364; E04D 13/03; E04D 13/031; E04D 13/0315
USPC ..... 52/200
See application file for complete search history.

(56) References Cited

U.S. PATENT DOCUMENTS 3,521,414 A 7/1970 Malissa
3,791,088 A 2/1974 Sandow et al.
3,828,494 A 8/1974 Uhrhane et al.
3,967,423 A 7/1976 Hammond
4,117,638 A 10/1978 Kidd, Jr. et al.
4,123,883 A 11/1978 Barber, Jr. et al.
4,155,206 A 5/1979 Player
4,296,581 A 10/1981 Heckelsberg
4,470,230 A 9/1984 Weisner
(Continued)

FOREIGN PATENT DOCUMENTS

GB 981948 2/1965
JP 2000336859 5/2000
(Continued)

OTHER PUBLICATIONS

FAA Facility, photos of skylight installation, 3 pages, Sacramento, CA, prior to 2007.
(Continued)

*Primary Examiner* — Andrew J Triggs
(74) *Attorney, Agent, or Firm* — Thomas D. Wilhelm; Northwind IP Law, S.C.

(57) ABSTRACT

Metal panel roofs, and load support structures for supporting loads on such roofs. Side rails provide primary support for loads on such roofs. The side rails can be fabricated from sheet metal or can be extruded. A side rail includes a standing seam cavity which is lowered, and covers, the standing seam. Side walls of the standing seam cavity. An upstanding web extends up from the cavity, and lower shoulders may extend laterally, optionally downwardly, from the walls which define the cavity, on either one side, or both sides, of the cavity. Building roof insulation can extend up through an aperture in the roof, surrounded by such load support structure, and extend up to the top of the side rail, thus providing a thermal break between the load support structure elements and the space surrounded by the load support structure.

29 Claims, 30 Drawing Sheets

(56) References Cited

U.S. PATENT DOCUMENTS

| | | | | | |
|---|---|---|---|---|---|
| 4,520,604 | A | | 6/1985 | Halsey et al. | |
| 4,543,753 | A | | 10/1985 | Sonneborn et al. | |
| 4,559,753 | A | | 12/1985 | Brueske | |
| 4,621,466 | A | | 11/1986 | Sonneborn et al. | |
| 4,649,680 | A | | 3/1987 | Weisner et al. | |
| 4,703,596 | A | | 11/1987 | Sandow | |
| 4,730,426 | A | | 3/1988 | Weisner et al. | |
| 4,776,141 | A | | 10/1988 | Powell | |
| 4,825,608 | A | | 5/1989 | Makin | |
| 4,848,051 | A | | 7/1989 | Weisner et al. | |
| 4,860,511 | A | | 8/1989 | Weisner et al. | |
| 4,941,300 | A | | 7/1990 | Lyons, Jr. | |
| 4,972,638 | A | * | 11/1990 | Minter | 52/200 |
| 4,986,039 | A | | 1/1991 | Weisner | |
| 5,027,576 | A | | 7/1991 | Gustavsson | |
| 5,323,576 | A | | 6/1994 | Gumpert et al. | |
| 5,511,354 | A | | 4/1996 | Eidson | |
| 5,522,189 | A | | 6/1996 | Mortensen et al. | |
| 5,553,425 | A | * | 9/1996 | Sampson et al. | 52/58 |
| 5,561,953 | A | | 10/1996 | Rotter | |
| 5,896,711 | A | * | 4/1999 | McClure | 52/200 |
| 5,960,596 | A | * | 10/1999 | Lyons, Sr. | 52/200 |
| 6,079,167 | A | * | 6/2000 | Voegele, Jr. | 52/200 |
| 6,151,838 | A | | 11/2000 | Husein | |
| 6,640,508 | B2 | | 11/2003 | Lindgren et al. | |
| 6,966,157 | B1 | | 11/2005 | Sandow | |
| 7,043,882 | B2 | | 5/2006 | Gumpert et al. | |
| 7,296,388 | B2 | | 11/2007 | Valentz et al. | |
| 7,308,777 | B2 | | 12/2007 | Sandow | |
| 7,395,636 | B2 | | 7/2008 | Blomberg | |
| 7,712,279 | B2 | | 5/2010 | McClure | |
| 7,721,493 | B2 | | 5/2010 | Skov et al. | |
| 7,736,014 | B2 | | 6/2010 | Blomberg | |
| 8,438,798 | B2 | * | 5/2013 | McLain et al. | 52/200 |
| 8,438,799 | B2 | * | 5/2013 | McLain et al. | 52/200 |
| 8,438,800 | B2 | * | 5/2013 | McLain et al. | 52/200 |
| 8,438,801 | B2 | * | 5/2013 | McLain et al. | 52/200 |
| 2004/0049996 | A1 | | 3/2004 | Blomberg | |
| 2005/0204674 | A1 | | 9/2005 | Marshall | |
| 2006/0191230 | A1 | | 8/2006 | Gumpert | |
| 2007/0094984 | A1 | | 5/2007 | McClure | |
| 2007/0101665 | A1 | | 5/2007 | Sandow | |
| 2008/0040993 | A1 | | 2/2008 | Valentz et al. | |
| 2008/0190050 | A1 | | 8/2008 | McClure | |
| 2010/0162643 | A1 | * | 7/2010 | Blomberg et al. | 52/200 |
| 2011/0252726 | A1 | * | 10/2011 | McLain et al. | 52/200 |
| 2011/0252727 | A1 | * | 10/2011 | McLain et al. | 52/200 |
| 2012/0233941 | A1 | * | 9/2012 | McLain et al. | 52/200 |
| 2012/0233942 | A1 | * | 9/2012 | McLain et al. | 52/200 |
| 2013/0167459 | A1 | * | 7/2013 | Pendley et al. | 52/200 |
| 2013/0219825 | A1 | * | 8/2013 | Pendley et al. | 52/710 |

FOREIGN PATENT DOCUMENTS

| | | |
|---|---|---|
| JP | 2001214577 | 8/2001 |
| JP | 2008202372 | 9/2008 |
| WO | 2010040006 | 4/2010 |

OTHER PUBLICATIONS

Cross-section and pictorial views of SSR-TUF-LITE daylighting panels, received Jun. 20, 2012, 1 sheet.

Cross-section of VP TUF-LITE Panel—attached to the side of SSR rib, received Jun. 20, 2012, 1 sheet.

Cross-section of Butler LITE Panel—attached to the side of MR24 rib, received Jun. 20, 2012, 1 sheet.

Siemens Building, photos of skylight installation, 6 pages, prior to 2007.

R & S Manufacturing and Sales Company, Inc., Standing Seam 24 Light, Quick Installation Instructions, Under/Over Seam Clip, 12 pages, Newbury Park, CA, date unknown.

R & S Manufacturing and Sales Company, Inc., SS 24 Light, The First Truely Thermally Broken Metal Building Skylight, informational sheet, 1 page, Newbury Park, CA, date unknown.

R & S Manufacturing and Sales Company, Inc., Enlarged sketch of metal roof showing the down slope, 1 page, Newbury Park, CA, date unknown.

Daljcon, LLC., Butler Manufacturing, www.daljcon.com, Example of 6 Layer Standing Seam, printed Dec. 11, 2012.

* cited by examiner

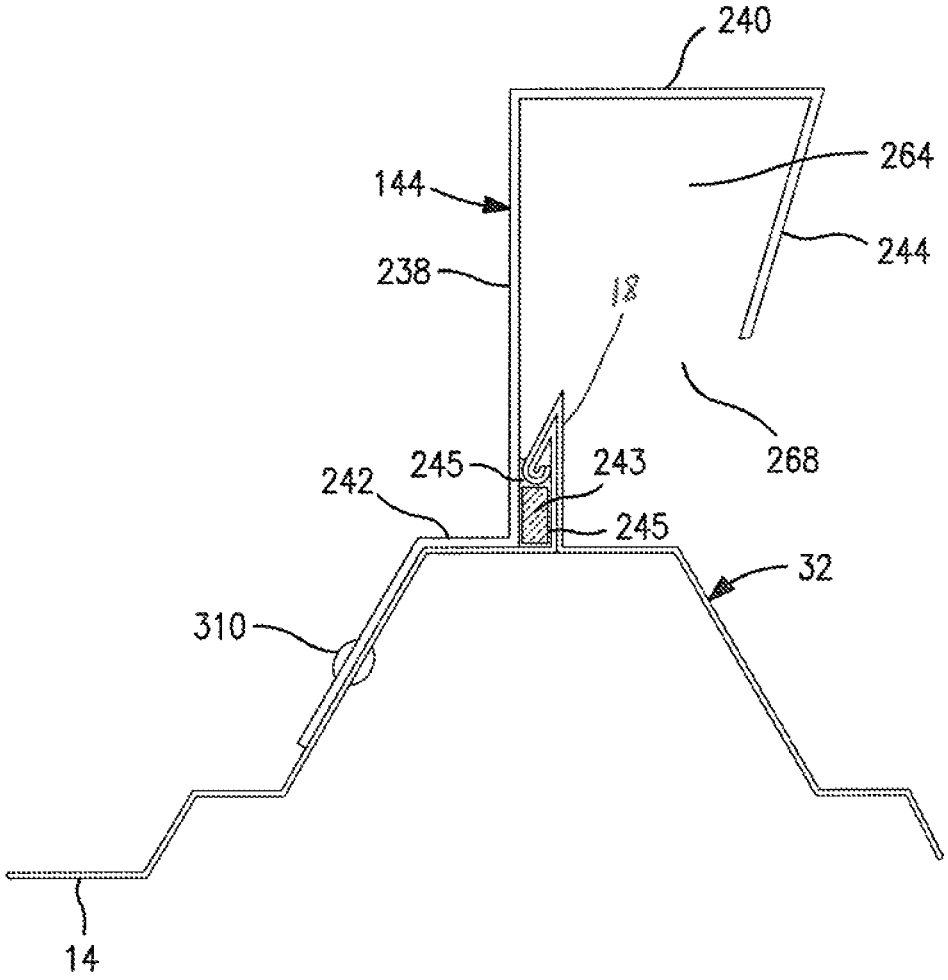
FIG. 8A1

SUPPORT STRUCTURES ON ROOFS

BACKGROUND OF THE INVENTION

Various systems are known for supporting loads on roofs, and for installing skylights and/or smoke vents into roofs.

Commonly used skylighting systems have translucent or transparent closure members, also known as lenses, mounted on a support structure which extends through an aperture in the roof and is mounted to building support members inside the building. Ambient daylight passes through the lens and thence through the roof aperture and into the building.

Thus, conventional skylight and smoke vent installations use a complex structure beneath the exterior roofing panels and inside the building enclosure, in order to support a curb which extends through the roof and supports the skylight lens. Conventional skylight curbs, thus, are generally in the form of a preassembled box structure surrounding an aperture which extends from the top of the box structure to the bottom of the box structure. Such box structure is mounted to building framing members inside the building enclosure, and extends through a respective aperture in the roof, similar in size to the aperture which extends through the box structure while accounting for the thickness of the elements of the box structure. The skylight assembly thus mounts inside the building enclosure, and extends through an aperture in a separately mounted roof structure. Fitting skylight assemblies into such roof aperture, in a separately-mounted roof structure, presents problems in that all known conventional structures have a tendency to leak water when subjected to rain.

In light of the leakage issues, there is a need for a more effective way to support skylights and smoke vents, thus to bring daylight into buildings.

To achieve desired levels of daylighting, conventional skylight installations use multiple roof apertures spaced regularly about the length and width of a given roof surface through which daylight is to be received. Each skylight lens is installed over a separate such aperture; and the aperture for each such skylight assembly, each representing a single lens, extends across multiple elongate metal roof panels.

The opposing sides of conventional metal roof panels, to which skylight assemblies of the invention are mounted, are elevated above elongate centralized panel flats which extend the lengths of the panels, whereby the sides of adjacent such roof panels are joined to each other to form elongate elevated joints, referred to herein as elevated ribs. The aperture for a conventional skylight cuts across multiple such elevated ribs in order to provide a large enough aperture to receive conventionally-available commercial-grade skylight assemblies. The skylight assembly, itself, includes a curb which is mounted inside the building and extends, from inside the building, through the roof aperture and about the perimeter of the aperture, thus to support the skylight lens above the flats of the roof panels, as well as above the elevated ribs. Conventional pliable tube construction sealants are applied about the perimeter of the roof aperture, between the edges of the roof panels and the sides of the skylight assembly curb, including at the cut ribs. Typically, substantially all of such sealant is applied in the panel flats, which means that such sealant is the primary barrier to water leakage about substantially the entire perimeter of the skylight curb. One of the causes of roof leaks around the perimeter of conventional roof curbs which attach primarily through the panel flat at the water line are due to foot traffic, such as heel loads or other dynamic loads imposed by workers wheeling gas cylinders or other heavy equipment on the roof panel e.g. with dollies. This type of dynamic loading can cause high levels of stress on the joints that rely solely on mastic to provide seals in the wet areas, namely in the panel flats. Such leaks are common around fastener locations as the panels flex under load and cause the sealant to deform such that, in time, passages develop through the sealant, which allows for the flow of water through such passages, thus developing the above-mentioned leaks.

Such multiple curbs, each extending through a separate roof aperture, each sealed largely in the panel flats, create multiple opportunities for water to enter the interior of the building. Applicants have discovered that such opportunities are influenced by, without limitation, (i) the number of individual apertures in the roof,
(ii) the widths of the apertures, which require cuts through the multiple ribs,
(iii) the tendency of water to collect and stay at the upper end of an aperture,
(iv) the disparate expansion and contraction of the roof panels relative to the skylight curb; and
(v) the lengths of sealed seams in the panel flats.

The traditional curb constructions and methods of attachment in most cases thus require that a complicated support structure be installed below the metal roofing and inside the building enclosure, and supported by the building structural support system which allows disparate/discordant movement of the metal roof panels and the skylight assembly relative to each other, as associated with thermal expansion and contraction of the metal roof and the building structural support system e.g. in response to differences in temperature changes inside and outside the building.

In addition, conventional curb-mounted skylights tend to accumulate condensation, especially about fasteners which extend from the outside of the building to the inside of the climate-controlled building envelope.

Thus, it would be desirable to provide a skylight system which provides a desired level of daylight in a commercial and/or industrial building while substantially reducing the incidence/frequency of leaks occurring about such skylights, as well as reducing the incidence/frequency of condensate accumulation in the areas of such skylights.

It would also be desirable to provide a smoke vent system or other roof penetration while substantially reducing the incidence/frequency of leaks occurring about such smoke vents or other roof penetrations, as well as reducing the incidence/frequency of condensate accumulation in the areas of such roof penetrations.

It would further be desirable to provide a support system, suitable for supporting roof loads, up to the load-bearing capacity of the metal roof while substantially controlling the tendency of the roof to leak about such support systems, as well as reducing the incidence/frequency of condensate accumulation in the areas of such closure support systems.

SUMMARY OF THE INVENTION

The invention provides a curbless construction system for installing roof load supports such as roof closure structures, optionally skylights and/or smoke vents, optionally including two or more such cover structures in end-to-end relationship, onto the major rib elevations of a building's metal roof panel system, thereby utilizing the beam strength of the roof rib elevations on the surface of the roof, as the support for such loads. Where skylight assemblies are placed in end-to-end relationship over a common roof aperture, the upper diverter and lower closure at the facing ends of such skylight assemblies are optionally replaced with male and female mating strips. Numerous roof structures include such ribs and rib elevations, sometimes deemed "ribs" or "corrugations", including the standing seam and exposed fastener roof types. The roof support and/or closure structures of the invention are fastened to the rib structures of the metal roof panels above the water line. By mounting the loads above the water line, the number of incidents of water leaks, especially leaks about the mounting structure, is greatly reduced. By mounting the loads on the roof panels, themselves, the supported loads, such as skylights or vents, can move with the respective roof panels as the roof panels expand and contract in accordance with temperature changes in the ambient environment outside the building.

The invention thus utilizes the beam strength of the rib elements of the roof panels as an integral part of the closure support structure.

In addition, the invention further improves control of water leakage and condensation formation inside the climate-controlled building envelope. Water leakage is reduced by suitably designing the upper diverter and the lower closure, and by providing a male/female intermediate joint where skylight assemblies meet end to end intermediate the length of the roof aperture. Condensation is reduced by providing insulation about the inner side of the support structure, thus to cover the sides of the load support structure which face the space surrounded by the load support structure above the aperture, optionally providing a no-fastener securement of the insulation at an upper location in the closure support structure, and providing thermally insulating materials as barriers to penetrating portions of fasteners, penetrating from outside the climate controlled building envelope, preventing such fasteners from entering the climate-controlled building envelope.

In a first family of embodiments, the invention comprehends a side rail for supporting one of opposing sides of a skylight or other cover over a roof penetration, the side rail having first and second opposing sides, and a length, and comprising an upstanding elongate web having a top and a bottom; and an upstanding elongate cavity wall laterally displaced from, and extending alongside, said upstanding web. A relatively upper portion of the cavity wall is connected to an intermediate portion of the upstanding web between the top and the bottom of the upstanding web. The combination of the upstanding cavity wall and the upstanding web defines a cavity between the upstanding web and the upstanding cavity wall, the cavity having a top and a bottom, and an elongate opening along the bottom of the cavity and proximate the bottom of the upstanding web.

In some embodiments, the side rail further comprises a lower shoulder extending laterally away from one of the upstanding elongate web and the upstanding elongate cavity wall proximate the bottom of the cavity.

In some embodiments, the lower shoulder comprises a first shoulder panel extending at an angle generally perpendicular to one of the upstanding web and the upstanding cavity wall.

In some embodiments, the side rail further comprises a second shoulder panel extending down from the first shoulder panel.

In some embodiments, the side rail further comprises a first lower shoulder extending laterally away from the upstanding web proximate the bottom of the cavity and away from the cavity, and a second lower shoulder extending laterally away from the upstanding wall proximate the bottom of the cavity, and away from the cavity, and away from the first lower shoulder.

In some embodiments, one of the first and second lower shoulders comprises a first shoulder panel extending laterally away from the cavity and a second shoulder panel extending down from the first shoulder panel.

In some embodiments, the other of the first and second lower shoulders comprises a third shoulder panel extending laterally away from the cavity and away from the first one of the first and second lower shoulders, and a fourth shoulder panel extending down from the third shoulder panel.

In some embodiments, the side rail further comprises a thickness reinforcement at a joinder of the upstanding web and the upstanding cavity wall.

In some embodiments, the side rail is an extruded metal side rail.

In some embodiments, the upstanding web and the first lower shoulder are defined in a first piece part and the upstanding wall and the second shoulder are defined in a second different piece part, and the first and second piece parts are joined to each other at an elevation at or above the top of the cavity.

In some embodiments, the side rail further comprises an upper flange extending laterally away from the upstanding web.

In some embodiments, the invention comprehends a load support structure on a sloping metal roof of a building, such roof of such building comprising a plurality of elongate metal roof panels which collectively define a plurality of elongate upstanding ribs extending between a ridge and an eave of the building, the ribs defining upstanding seams which have folded over terminal edges of the respective adjacent roof panels, the load support structure comprising first and second side rail structures comprising at least first and second ones of the side rails mounted on first and second ones of the upstanding ribs, the first and second side rail structures each having an up-slope end and a down-slope end, an upper diverter extending between the up-slope ends of the first and second side rail structures, and a lower closure extending between the down-slope ends of the first and second side rail structures.

In some embodiments, the invention comprehends a sloping metal roof of a building, the roof comprising a plurality of elongate metal roof panels which collectively define a plurality of elongate upstanding ribs extending between a ridge and an eave of the building, the ribs defining upstanding seams which have folded over terminal edges of the respective adjacent roof panels, a load support structure being mounted on the roof, the load support structure comprising first and second side rail structures comprising at least first and second ones of the side rails mounted on first and second ones of the upstanding ribs, the first and second side rail structures each having an up-slope end and a down-slope end, an upper diverter extending between the up-slope ends of the first and second side rail structures, and a lower closure extending between the down-slope ends of the first and second side rail structures.

In some embodiments, each of the first and second side rails further comprise an upper flange extending laterally away from the respective upstanding web and toward the other of the first and second side rails, and an inside web extending down from the respective upper flange, thereby defining a second cavity between the upstanding web and the inside web, an elongate block of thermal insulation being disposed in the second cavity and extending from the upper flange to the respective lower shoulder.

In some embodiments, the load support structure extends about an aperture in the roof, a layer of thermally-insulating material underlying the sloping metal roof about the aperture, the layer of thermally-insulating material extending up through the aperture and alongside the second cavity and between the block of thermal insulation material and a space surrounded by the load support structure over such aperture.

In some embodiments, the thermally insulating material underlying the roof comprises roof insulation, edges of the roof insulation being held against an upper portion of the side rail.

In some embodiments, the upstanding roof seam is disposed in the first cavity.

In some embodiments, a fastener extends through one of the upstanding web and the upstanding wall and into the upstanding seam in the first cavity.

In a second family of embodiments, the invention comprehends a side rail for supporting one of opposing sides of a skylight or other cover over a roof penetration, the side rail having first and second opposing sides, and a length, and comprising as a first piece part, an upstanding elongate web having a top and a bottom; as a second piece part, a cavity ridge comprising a first upstanding cavity wall, having a top and a bottom, and a second upstanding cavity wall having a top and a bottom, and being displaced from, and extending alongside, the first cavity wall, the first and second cavity walls being connected to each other at respective tops thereof thereby to define a cavity therebetween having a top and a bottom, and an elongate opening along the bottom of the cavity, the upstanding elongate web being joined to the cavity ridge along the second cavity wall, further comprising a lower shoulder connected to, and extending laterally away from, one of the upstanding web and the first cavity wall, and away from the cavity.

The present invention will be further appreciated and understood when considered in combination with the following description and accompanying drawings. It will be understood, however, that the following description is by way of illustration and not of limitation. Certain changes and modifications can be made within the scope of the invention without departing from the spirit of the invention, and the invention includes all such changes and modifications.

BRIEF DESCRIPTION OF THE DRAWINGS

FIG. 8A1 is an enlarged end/profile view of a side rail of the invention mounted at a standing seam, and illustrating a gap plug in the space between the outer panel of the rail and the metal roof seam, under the turned-over edges of the seam.

Figure 1:
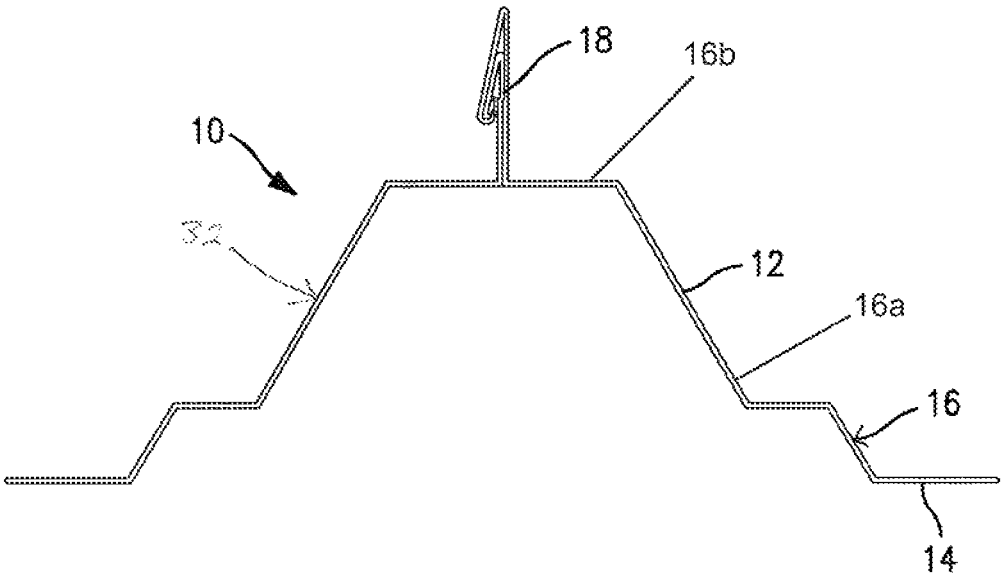
FIG. 1 is a fragmentary profile of a metal roof of type known generally as a standing seam roof.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

The products and methods of the present invention provide a load support structure, for use in installing various exterior roof loads which close off apertures in metal roofs. For purposes of simplicity, "load support structure" will be used interchangeably to mean various forms of closed-perimeter structures which are mounted on ribs of raised elevation metal roof structures, which surround an aperture in a roof, including across the flat of a roof panel, and which support either a cover over the aperture, or a vent or other conduit which extends through the roof aperture. Skylight assemblies and smoke vents are non-limiting examples of covers over such roof apertures. Air handling operations such as vents, air intakes, and air or other gaseous exchange to and/or from the interior of the building are non-limiting examples of operations where conduits extend through the roof aperture. In the case of roof ventilation, examples include simple ventilation openings, such as for roof fans, and smoke vents, which are used to allow the escape of smoke through the roof during fires. In the case of exterior loads on the roof, where no substantial roof aperture is necessarily involved there can be mentioned, without limitation, such loads as solar panels and other equipment related building utilities, and/or to controlling water or air temperatures inside the building. The only limitation regarding the loads to be supported is that the magnitude of a load must be within the load-bearing capacity of the roof panel or panels, including the strengths of the standing seams, to which the load is mounted.

The number of skylights or other roof loads can vary from one load structure, to as many load structures as the building roof can support, limited only by the amount of support available from the respective roof panels to which the load is attached.

The invention provides structure and installation processes, as a support system which utilizes the beam strength of the major rib structures, in the roof panels, as the primary support structure for mounting and fastening the e.g. skylight assembly to the roof.

One family of support structures of the invention comprehends a skylight system where a load support structure which supports such skylights is overlaid onto, and mounted to, the roof panels, and exposes the load support structure to the same ambient weather conditions which are experienced by the surrounding roof panels. Thus, the load support structure experiences approximately the same thermal expansions and contractions as are experienced by the respective roof panel or panels to which the load support structure is mounted. This is accomplished through direct attachment of the load support structure to the underlying metal roofing panels. According to such roof mounting, and such ambient weather exposure, expansion and contraction of the load support structure generally coincides, at least in direction, with concurrent expansion and contraction of the metal roof panels.

Referring now to the drawings, a given metal roof panel generally extends from the peak of the roof to the respective cave. Skylight systems of the invention contemplate the installation of two or more adjacent skylight assemblies in an end to end relationship along the major rib structure of a given such metal roof panel on the building whereby the individual skylight assemblies are installed in strips over a continuous, uninterrupted aperture in the metal roof, the aperture extending along a line which extends from the roof ridge to a corresponding eave.

Skylight systems of the invention can be applied to various types of ribbed roof profiles. FIG. 1 is an end view showing a profile of a metal roof of the type known generally as a standing seam roof. These include the "standing seam" roof, which has trapezoidal elevated elongate major ribs 32 typically 24" to 30" on center. Each roof panel 10 also includes a panel flat 14, and may include a shoulder 16 along the merger of a rib 32 with the panel flat. The elevated elongate ribs on a given panel cooperate with corresponding elevated elongate ribs on next-adjacent panels, thus forming standing seams 18. Seams 18 represent the edges of adjacent roof panels, folded one over the other, to form elongate joints at the side edges of the respective roof panels. The rib elevations on respective adjacent panels are folded over such that the standing seams function as folded-over raised joints between the respective panels, thus to inhibit water penetration of the roof at the standing seams/joints as well as to provide substantial load-bearing strength to the rib at the standing seam joint.

Figure 2:
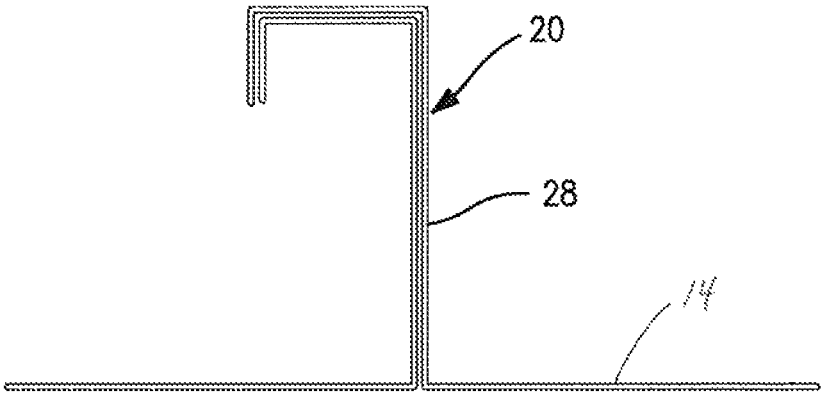
FIG. 2 is a fragmentary profile of a metal of a type commonly referred to as an architectural standing seam roof.

FIG. 2 is an end view showing the profile of a second example of a standing seam metal panel roof of the type known as an architectural standing seam roof, which uses a series of overlapping architectural standing seam panels 20. Each panel 20 comprises a panel flat 14, and a rib element of an architectural standing seam 28 on each side of the panel.

Figure 3:
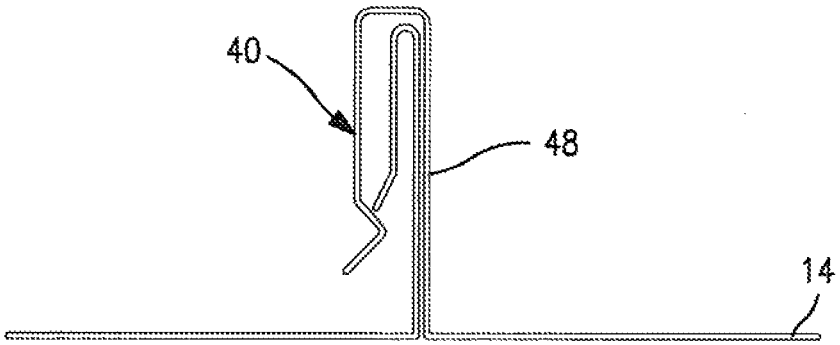
FIG. 3 is a fragmentary profile of a metal roof of a type commonly referred to as a snap seam, standing seam roof.

FIG. 3 is an end view showing the profile of a third example of a standing seam metal panel roof of the type commonly referred to as a snap rib seam panel 40. Snap seam panels 40 have a panel flat 14 and a standing seam or snap seam 48 where the adjacent panels meet.

Figure 4:
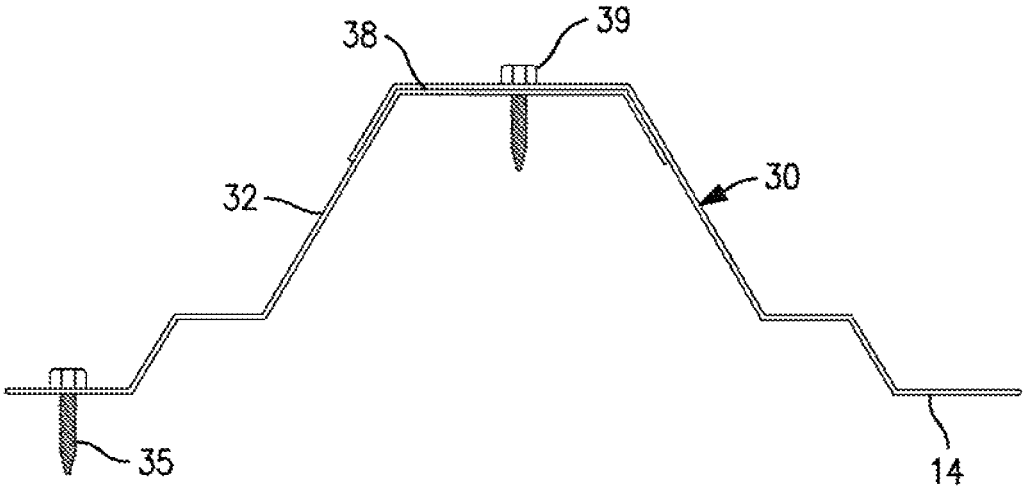
FIG. 4 is a fragmentary profile of a metal roof of a type commonly referred to as an exposed fastener roof.

FIG. 4 is an end view showing the profile of a metal roof of the type commonly referred to as an "R panel" or exposed fastener panel 30. Each panel has elements on opposing sides of a panel flat 14 which, with the rib elements of adjacent panels, form ribs 32. Adjacent R panels are secured to the roof by fasteners 35. At side lap 38, overlapping regions of adjacent panels are secured to each other by stitch fasteners 39. Trapezoidal major ribs of the R panel roof are most typically formed at 8 inches to 12 inches on center.

Figure 5:
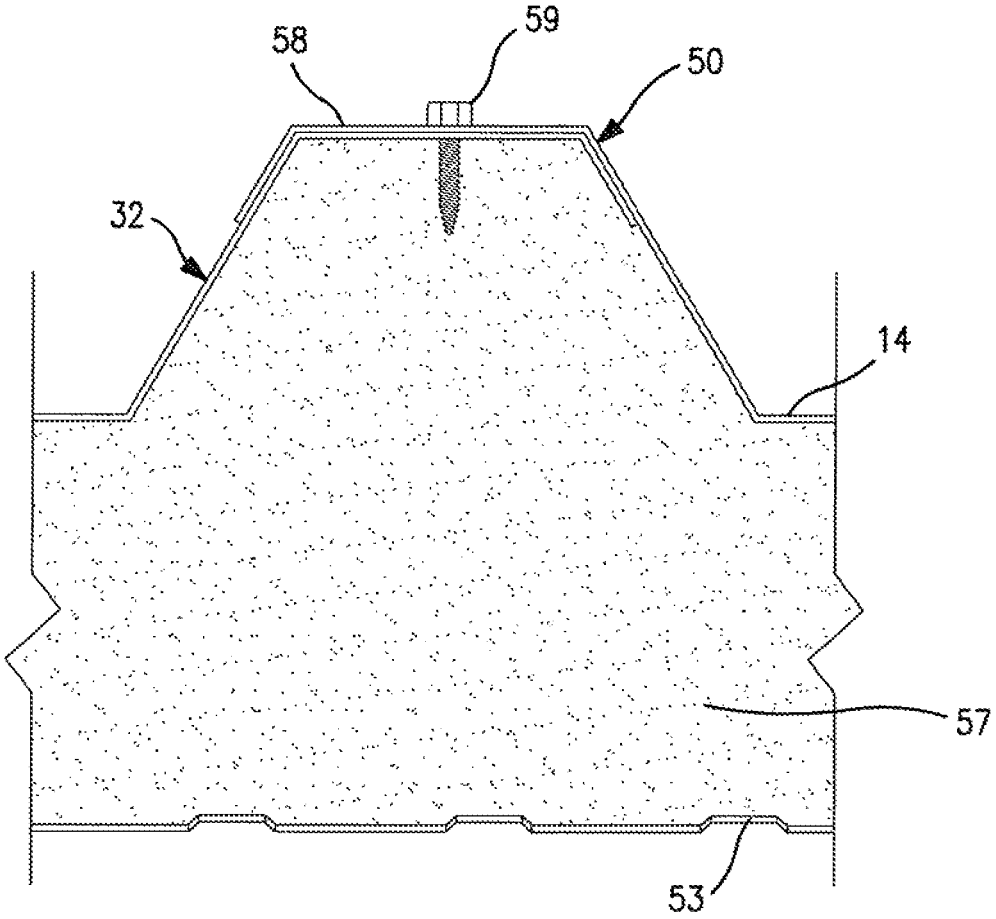
FIG. 5 is a fragmentary profile of a metal roof of type commonly referred to as a foam core roof.

FIG. 5 is an end view showing a profile of a second example of an exposed fastener metal panel roof of the type commonly referred to as a foam core panel 50. Such roof has a rib 32, a liner panel 53, a panel flat 14 and a foam core 57. Overlapping regions 58 of adjacent panels are secured to each other by fasteners 59.

A skylight/ventilation load support structure is illustrative of support structures of the invention which extend about the perimeter of roof-penetrating apertures, thus closing off lateral approach to such apertures from the sides and ends. Such load support structure surrounds the aperture in the roof, and is adapted to be mounted on, and supported by, the prominent standing elevations, standing rib structures, or other upstanding elements of conventional such roof panels, where the standing structures of the roof panels, namely structure which extends above the panel flats, e.g. at seams/joints where adjoining metal roof panels are joined to each other, provides the support for such load support structures. A such support structure is secured to the conventional metal roofing panels, and surrounds a roof aperture formed largely in the intervening flat region of a single metal roof panel.

Figure 6:
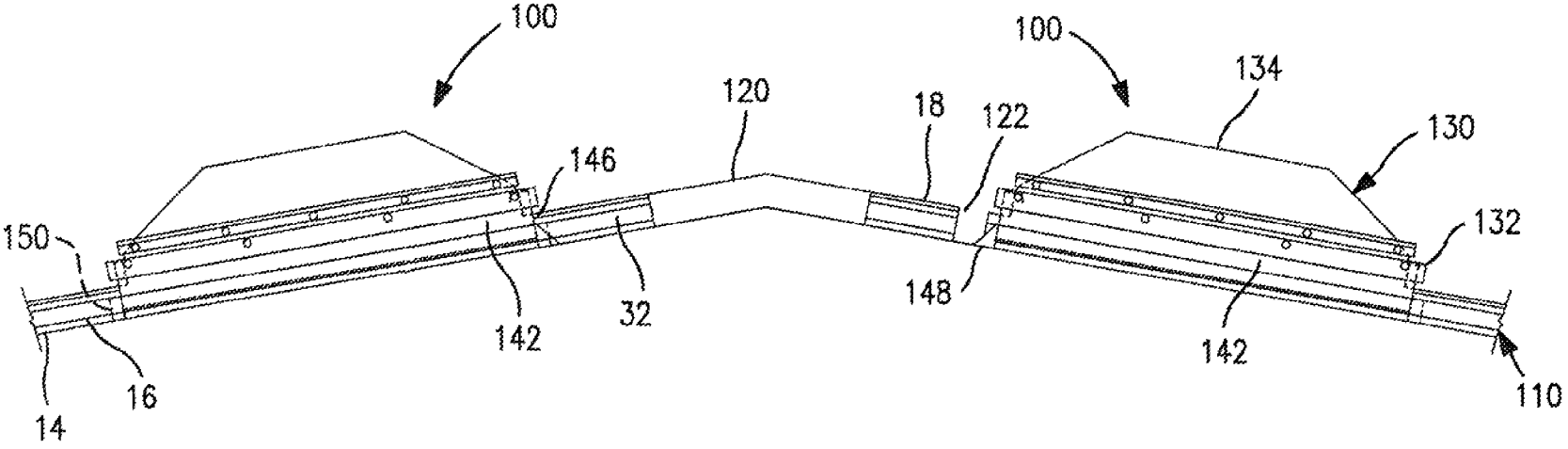
FIG. 6 is a side view showing major components of a skylight system of the invention, installed on a sloping metal panel roof.

FIG. 6 shows first and second exemplary load support structures 100, mounted to a standing seam panel roof 110, and overlain by covers defined by first and second skylight lens assemblies 130.

Figure 7:
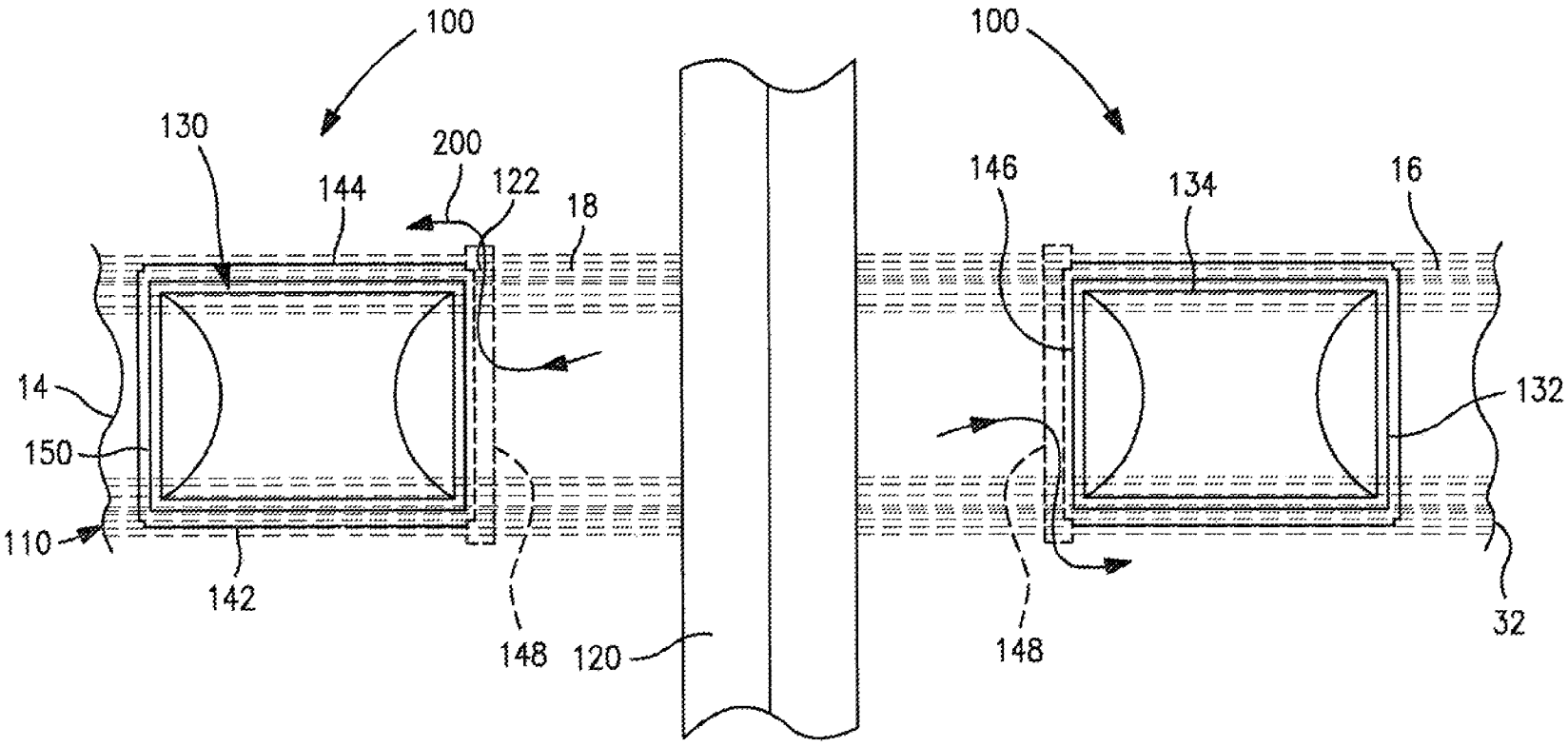
FIG. 7 is a top plan view of the installed skylight system of FIG. 6, showing placement of the skylights and the direction of water flow around the skylights.

FIG. 7 shows a portion of the roof 110 of FIG. 6, in dashed outline. The roof has a raised rib 32, a panel flat 14, shoulder 16 and standing seam 18. Given that water generally seeks the lowest level available at any given location, any water on a given roof panel tends to congregate/gather on the panel flat whereby, except for any dams across the panel flat, the water line is generally limited to the panel flat. Thus, rib 32, shoulder 16, and standing seam 18 are all typically above the water line. Also depicted in FIGS. 6 and 7 are ridge cap 120 of the roof structure, and cutaway regions, or diversion gaps 122 in the raised ribs 32.

Skylight assembly 130, which is part of the aperture closure system, generally comprises a skylight lens frame 132 mounted to the load support structure and extending about the perimeter of a given load support structure, in combination with a skylight lens 134 mounted to, and overlying, frame 132. An exemplary such skylight lens is that taught in U.S. Pat. No. 7,395,636 Blomberg and available from Sunoptics Prismatic Skylights, Sacramento, Calif.

Figure 7A:
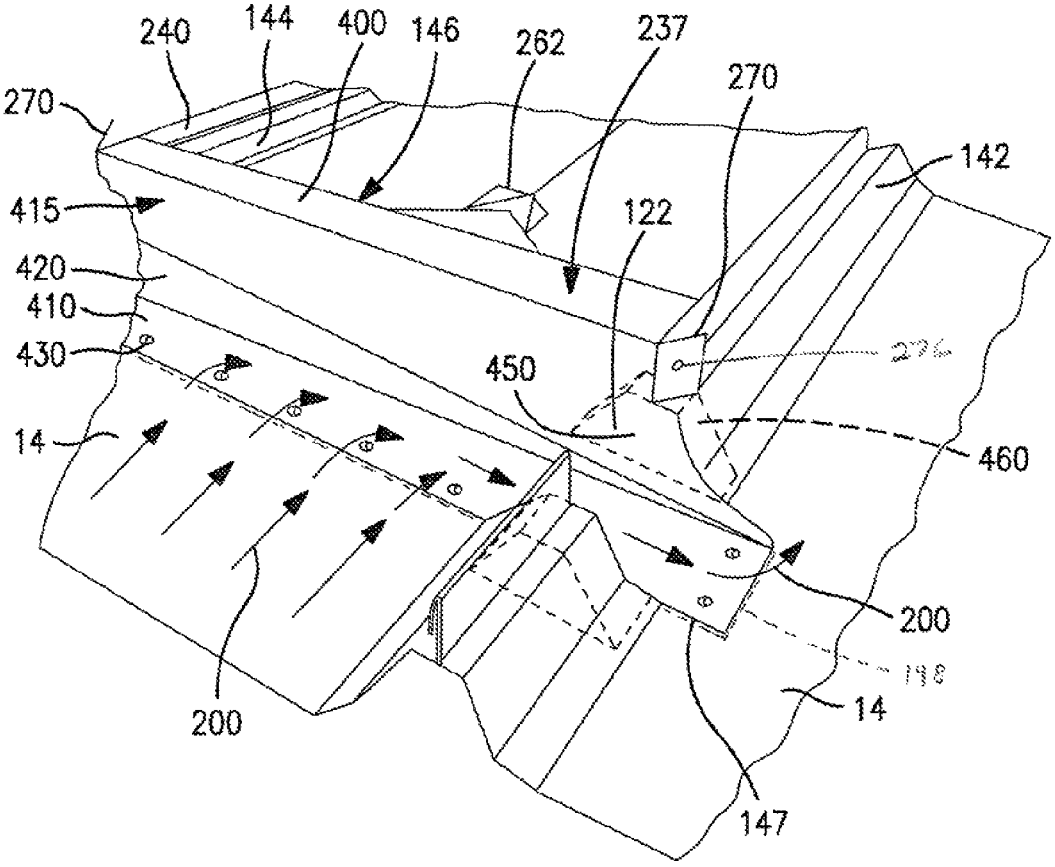
FIG. 7A is a cut-away pictorial view showing the upper diverter mounted in a diversion gap which has been cut through one of the roof ribs.

Referring to FIGS. 6 and 7, as well as to 7A, load support structure 100 of the invention, as applied to a skylight installation, includes one or more first side rails 142 and one or more second side rails 144 (FIGS. 8A, 8A1), upper diverter 146 disposed adjacent rib cutaway section, or diversion gap 122, and a lower closure. As shown in FIG. 7A, a lateral leg 147 of the upper diverter is located in diversion gap 122, filling the bottom and lower portions of the gap and carrying water laterally across the width of the respective rib, to the panel flat 14 of the adjacent roof panel, thus to transport the water away from the upper end of the skylight and to prevent the water from leaking through the roof opening. Load support structure 100 also includes support plates, connectors, bridging members, and rubber or plastic plugs to make various connections to the rail and closure structure elements as well as to close gaps/spaces between the various load support structure elements, and between the roof panels and the rail and closure structure elements, thus to complete the seals which prevent water leakage about the skylight and its associated aperture in the roof.

FIGS. 7 and 7A show how diversion gap 122 in rib 32, in combination with upper diverter 146, provides for water flow, as illustrated by arrows 200, causing the water to move laterally along the roof surface, over lateral leg 147 of the upper diverter, and down and away from the roof ridge cap 120 in panel flat 14 of the roof panel which is next adjacent the roof structures which support the respective e.g. skylight.

Lower closure 150 closes off the roof aperture from the outside elements at the down-slope end of the e.g. skylight or strip of skylights, thus to serve as a barrier to water leakage at the down-slope end of the aperture in the roof.

Figure 8A:
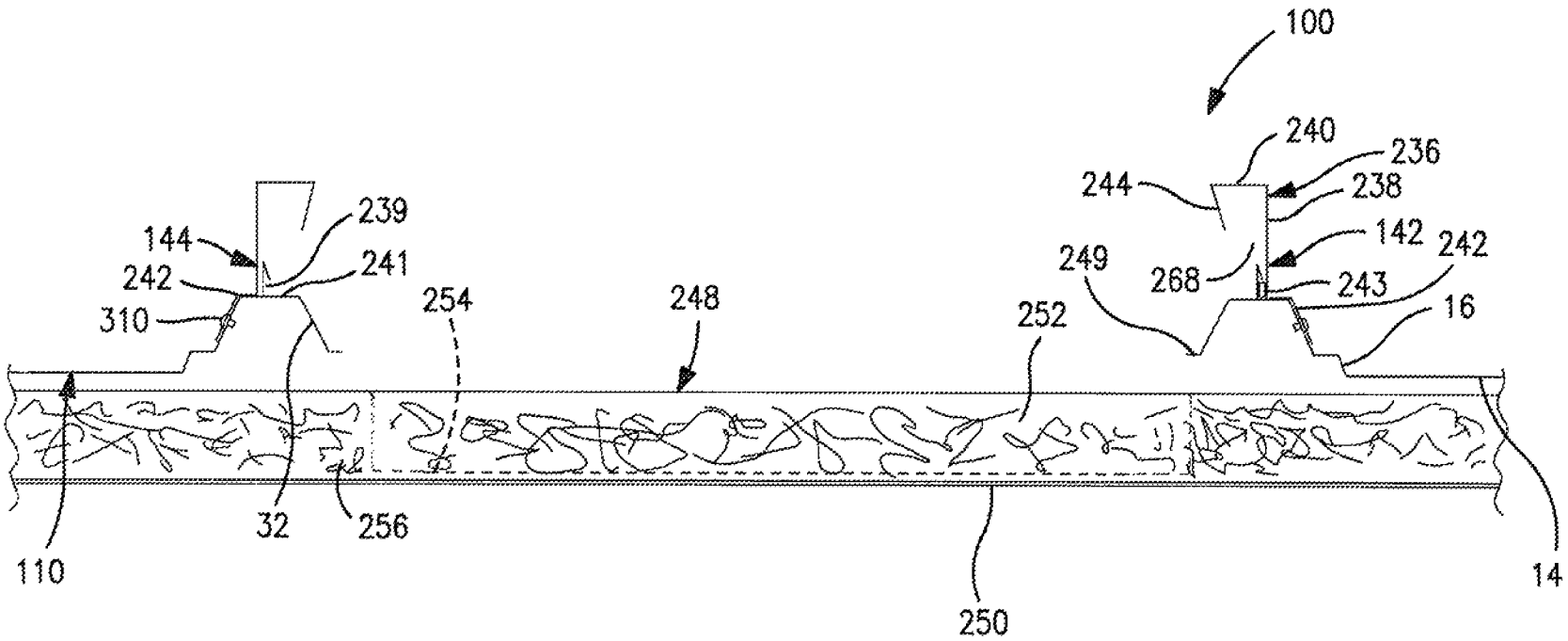
FIG. 8A is a cross sectional view showing connections of the rails to the rib elevations of a metal panel roof where the panel flat has been removed; the rail structure being affixed to the surfaces of adjacent rib elevations, wherein the portion of the underlying building roof insulation which is to be removed is shown above a dashed outline, and a gap plug has been installed between the standing seam and the upstanding web of the rail on the right side of the drawing, providing relatively solid mass in the gap between the rail and the folded-over standing seam.

Referring now to FIGS. 8A and 8A1, a cross section through rib 32, and associated load support structures 100 shows securement of the load support structures 100 to standing rib portions of the standing seam panel roof 110. FIG. 8A depicts the use of ribs 32 to support side rails 142 and 144 on opposing sides of the panel flat 14. Each rail 142 or 144 has a lower rail shoulder 242 and a rail upper support structure 236. Rail upper support structure 236 has a generally vertically upstanding outer web 238, a generally horizontal rail upper flange or bearing panel 240, and a rail inside panel 244. Inside panel 244 extends toward outer web 238 at an included acute angle of about 75 degrees between panel 240 and panel 244.

The profile of rail shoulder 242 is shaped to fit closely over the outside profile of the roof rib 32, and is secured to roof rib 32 by a plurality of fasteners 310 such as rivets or screws spaced along the length of the rib.

In each rib joint, the edges of the two roof panels are folded together, one over the other, as illustrated in e.g. FIGS. 8 and 8A1, leaving a space 239 between the bottom edges of the folded 25' over panel edges and the underlying top flat surface 241 of the rib. Where the space 239 faces the outer web of the rail, as at the right side of FIG. 8A, and as shown in FIG. 8A1, a standing seam gap plug 243 is disposed in space 239 on both sides of gap 122, between the turned-over edge of the standing seam and the outer web of the rail.

Where space 239 faces away from outer web 238 of the side rail, as at the left side of FIG. 8A, the flat surface of outer web 238 can be brought into a close enough relationship with the standing seam that any spaces between the standing seam and the outer web can be closed by pliable tube sealants. Thus, no gap plug is typically used between outer web 238 and the standing seam where the edge of the seam is turned away from the outer web.

Gap plug 243 is relatively short, for example about 1.5 inches to about 2.5 inches long, and has a width/height cross-section, shown in FIG. 8A1, which loosely fills space 239. The remainder of the space 239, about plug 243, namely between plug 243 and outer web 238, and between plug 243 and the standing seam, is filled with e.g. a pliable construction sealant 245. Plug 243 thus provides a solid fill piece at spaces 239 where there is some risk of water entry into the aperture, and where the space 239 is too large for assurance that a more pliable sealant can prevent such water entry.

A gap plug 243 is made of a relatively solid, yet resilient, e.g. EPDM (ethylene propylene diene monomer) rubber, which provides relatively solid e.g. relatively non-pliable mass in space 239 between the folded-over standing seam and outer web 238 of the rail, and relatively pliable, putty-like, tape mastic and tube caulk or the like are used to fill the relatively smaller spaces which remain after the gap plug has been inserted in the respective gap/space. Bearing panel 240, at the top of the rail, is adapted to support skylight frame 132, seen in FIG. 8D. Inside panel 244 of the rail extends down from the inner edge of bearing panel 240.

Referring back to FIG. 8A, insulation 248 is shown below the aperture 249 in the metal roof panel. Insulation 248 has a facing sheet 250 underlying a layer of e.g. fiberglass batt material 252. Dashed line 254 outlines an approximation of a portion of the fiberglass batt material which is to be removed. An edge portion 256 of batt material is left extending into aperture 249 for use described e.g. with respect to FIG. 8C.

Rails 142, 144 fit closely along the contours of ribs 32 whereby cross-section profiles of the rails closely follow the cross-section profiles of the ribs such that the ribs and rails are in face-to-face contact with each other over extended lengths of the respective rails and ribs, optionally along the top to bottom heights of areas of the rails which face the ribs. Upper diverter 146 and lower closure 150 have similar end contours which match the cross-panel contours of the respective ribs 32 as well as flats 114. The various mating surfaces of structure 100 and roof 110 can be sealed in various ways known to the roofing art, including caulk or tape mastic. Plastic or rubber fittings or inserts such as plugs 243 and 460 (FIG. 11) can be used to fill larger openings at the rails and ribs.

Figure 8B:
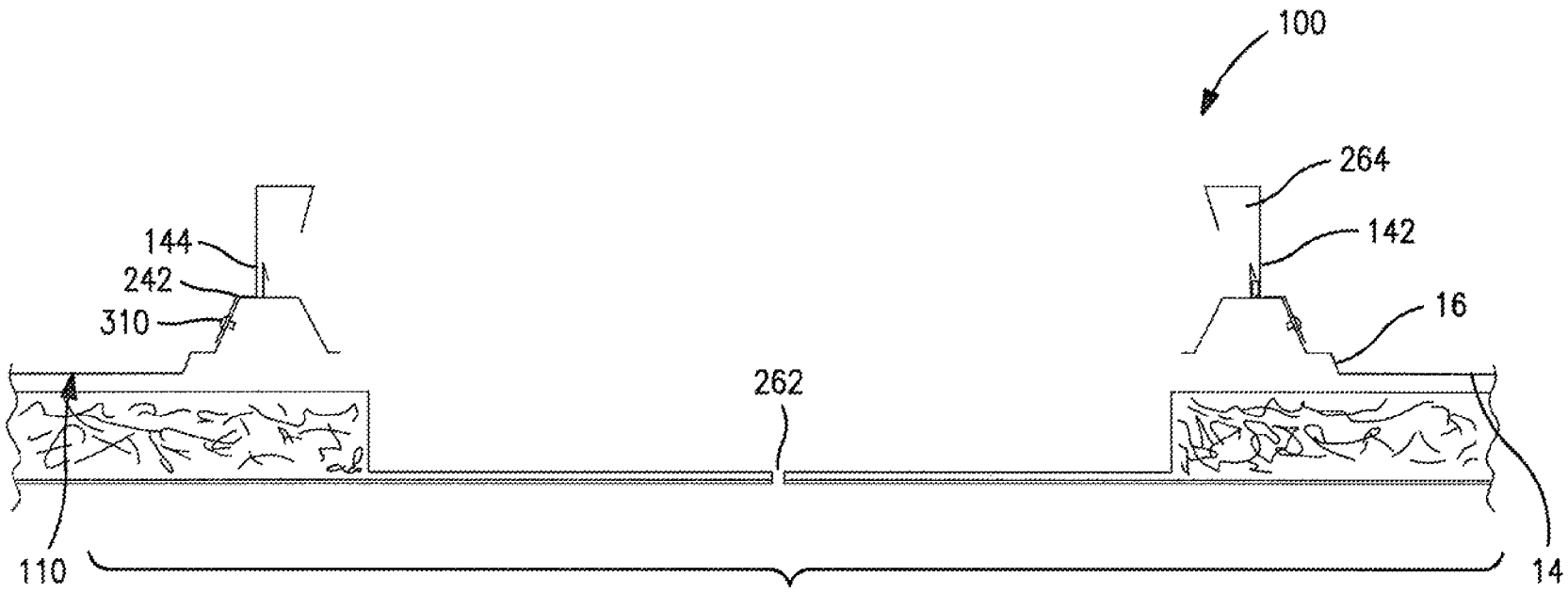
FIG. 8B shows a cross-section as in FIG. 8A, after removal of that portion of the insulation which was to be removed, and the insulation facing sheet cut down the middle along the length of the aperture/opening in the metal roof.

FIG. 8B shows the insulation batt material, marked with a dashed outline in FIG. 8A, removed from its position under the central portion of the aperture in the metal roof panel, cleaning much of the batt material from that portion of the facing sheet. The facing sheet is then cut the full length of the roof-penetrating aperture 249 over which the one or more skylight lenses are to be installed. At the ends of aperture 249, the cut is spread to the corners of the aperture. A such "Y"-shaped cut 262 is illustrated at the upper end of the aperture in FIG. 7A, wherein the ends of the "Y" extend to approximately the upper corners of the aperture.

Figure 8C:
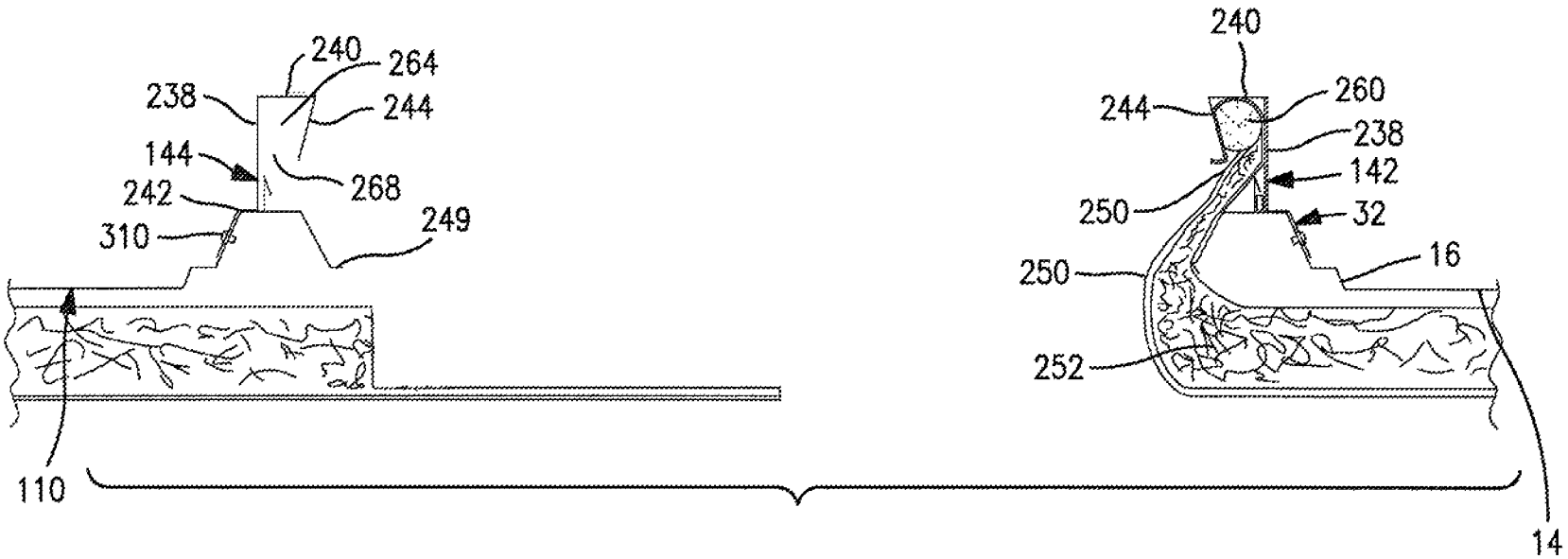
FIG. 8C shows a cross-section as in FIGS. 8A and 8B wherein the insulation facing sheet on one side of the aperture/opening has been raised and tucked into the cavity in the rail, and is being held in the cavity by a thermally-insulating compressible foam retainer rod.

FIG. 8C shows one side of the facing sheet lifted out of the aperture 249. The facing sheet and edge portion 256 of the insulation batting have been raised. A resilient foam retaining rod 260 has been forced into cavity 264 in the rail, with the facing sheet captured between the retaining rod and the rail surfaces which define cavity 264, which capture and holding of the facing sheet holds the insulation batting of edge portion 256 against the respective rib 32. Facing sheet 250 enters cavity 264 against outer web 238 of the rail, extends up and over/about rod 260 in the cavity, and thence extends back out of cavity 264 to a terminal end of the facing sheet outside cavity 264. Thus, rod 260 positions edge portion 256, as thermal insulation, against rib 32, and also positions the facing sheet vapor barrier between the climate-controlled space 266 inside the building and the perimeter of the load support structure.

The uncompressed, rest cross-section of rod 260 in cavity 264 is somewhat greater than the slot-shaped opening/access path 268 between inside panel 244 and the top of standing seam 18. Thus retainer rod 260 necessarily is deformable, and the cross-section of the rod is compressed as the rod is being forced through opening 268. After passing through opening 268, rod 260 expands against web 238 and panels 240 and 244 of the cavity while remaining sufficiently compressed to urge facing sheet 250 against web 238 and panels 240, 244, and 246 of the cavity whereby facing sheet 250 is assuredly retained in cavity 264 over the entire length of the rail or rails. A highly resilient, yet firm, polypropylene or ethylene propylene copolymer foam is suitable for rod 260. A suitable such rod, known as a "backer rod" is available from Bay Industries, Green Bay, Wis.

In other embodiments of the side rails, inside panel 244 is resiliently deflectable outwardly and away from web 238, whereby panel 244 can deflect to admit a generally non-deformable, e.g. generally non-compressible rod 260. While all materials exhibit some degree of deformability and compressibility, even if miniscule, the rods considered non-deformable and non-compressible are generally considered rigid and/or hard, thus not soft foams or rubbers.

Upper diverter 146 and lower closure 150, discussed in more detail hereinafter, extend across the flat of the metal roof panel between the upper and lower ends of roof aperture 249 to complete the closure of load support structure 100 about the perimeter of the skylight aperture. The upper diverter and the lower closure have upper support structures 237 having cross-sections corresponding to the cross-sections of upper support structures of rails 142, 144. Those upper support structures thus have corresponding flange cavities which are used, with rods 260, to capture and hold facing sheet 250 at the upper diverter and lower closure. Thus, the facing sheet is trapped in a cavity at the upper reaches of the load support structure about the entire perimeter of the load support structure. Bridging tape or the like can be used to bridge between the side portions and end portions of insulation facing sheet 250, such that the facing sheet completely separates the interior of the surrounded space inside skylight cavity 274 from the respective elements of load support structure 100.

Figure 8D:
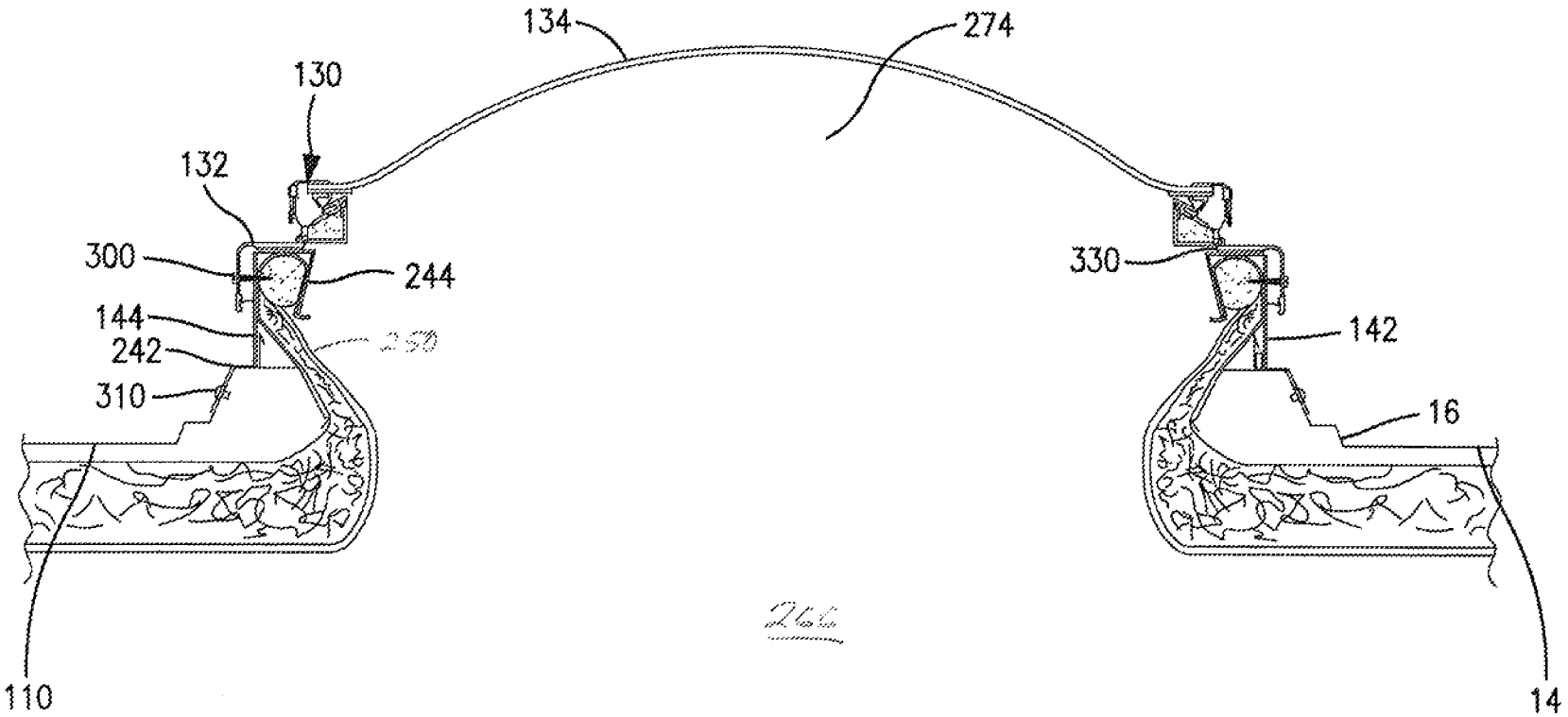
FIG. 8D shows a cross-section as in FIGS. 8A-8C wherein the facing sheet on both sides of the aperture/opening has been tucked into the rail cavity and is being held in the cavity by the foam retainer rod shown in FIG. 8C; and the skylight lens subassembly has been mounted to the rails, serving as a closure/cover over the aperture in the metal roof.

FIG. 8D shows facing sheet 250 trapped in the rail cavities on both sides of the roof aperture. FIG. 8D further shows the skylight subassembly, including frame 132 and lens 134, mounted to rails 142, 144. A sealant 330 is disposed between bearing panel 240 and skylight frame 132, to seal against the passage of water or air across the respective joint. A series of fasteners 300 extend through outer web 238 of the rail and extend into resilient rod 260, whereby rod 260 insulates the inside of the roof aperture from the temperature differential, especially cold, transmitted by fasteners 300, thereby to avoid fasteners 300 being a source of condensation inside the skylight cavity 274, namely below the skylight lens.

Figure 9:
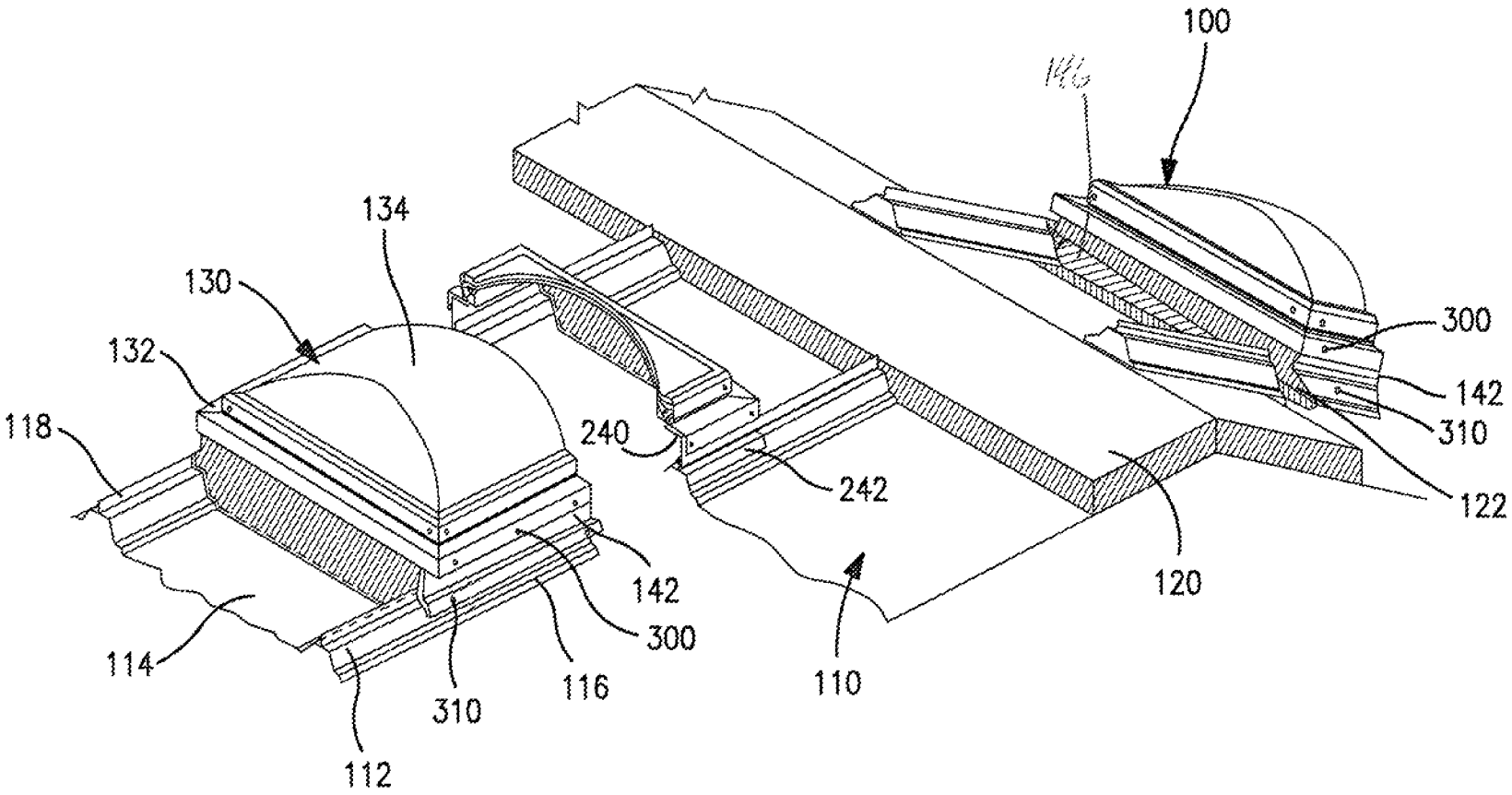
FIG. 9 is a perspective view partially cut away showing internal structure of a system of the invention as installed on rib elevations of a metal roof.

In FIG. 9, a partially cut away perspective view of load support structures 100 is used to show support of the load support structure by standing seam panel roof 110, particularly the elevated rib 32 providing the structural support at the standing seams. FIG. 9 illustrates how the load support structures cooperate with the structural profiles of the roof panels of the metal roof structure above and below the skylights, including following the elevations and ribs in adjacent ones of the panels, and thereby providing the primary support, by the roof panels, for the loads imposed by the skylights. In this fashion, the load support structures of the invention adopt various ones of the advantages of a standing seam roof, including the beam strength features of the standing seam at the ribs, as well as the water flow control features of the ribs.

Most standing seam roofs are seamed using various clip assemblies that allow the roof panels to float/move relative to each other, along the major elevations, namely along the joints between the respective roof panels, such joints being defined at, for example, elevated ribs 32. By accommodating such floating of the panels relative to each other, each roof panel is free to expand and contract according to e.g. ambient temperature changes irrespective of any concurrent expansion or contraction of the next-adjacent roof panels. Typically, a roof panel is fixed at the eave and allowed to expand and contract relative to a ridge. In some roofs, the panels are fixed at midspan, whereby the panels expand and contract relative to both the eave and ridge.

The design of skylight systems of the invention takes advantage of such floating features of contemporary roof structures, such that when skylight assemblies of the invention are secured to respective rib elevations as illustrated herein, the skylight assemblies, themselves, are supported by the roof panels at ribs 32. Thus, the skylight assemblies, being carried by the roof panels, move with the expansion and contraction of the respective roof panels to which they are mounted.

FIG. 9 shows panel flat 114, rib 32, and shoulder 116, as well as standing seam 118. Ridge cap 120 is shown at the roof peak. Diversion gap 122 in a rib 32 is shown at upper diverter 146.

In the process of installing a skylight system of the invention, a short length of one of the ribs 32, to which the load support structure is to be mounted, is cutaway, forming diversion gap 122 in the respective rib, to accommodate drainage at the upper end of the load support structure (toward ridge cap 120). Such diversion gap 122 is typically used with standing seam, architectural standing seam, and snap seam roofs, and can be used with any other roof system, such as an exposed fastener system, which has elevated elongate joints and/or ribs. In some instances, especially where the roof has no standing seams, the ribs on both sides of the skylight may be cut.

The retained portions of rib 32, namely along the full length of the skylight as disposed along the length of the respective roof panel, and especially the standing seams, provide beam-type structural support, supporting side rails 142 and 144 and maintaining the conventional watertight seal at the joints between roofing panels, along the length of the assembly. Portions of ribs 32, inside cavity 274, may be removed to allow additional light from skylight lens 130 to reach through the respective roof opening/aperture.

Figure 10:
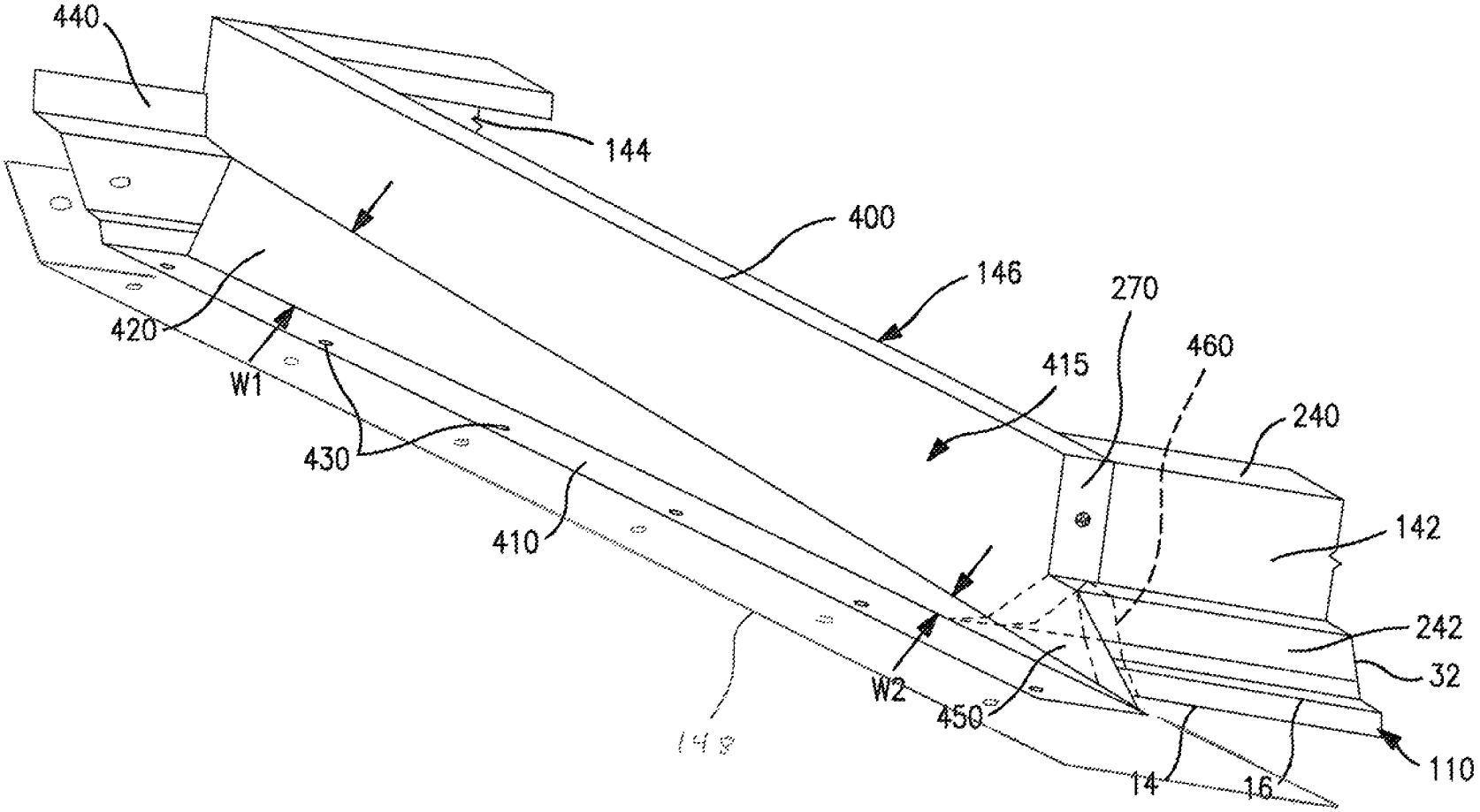
FIG. 10 is a perspective view of an upper diverter and its underlying reinforcing plate showing trailing closure ears extending from the ends of the intermediate end panel, and closed over the upright sides of the respective side rails.

As part of the installation of upper diverter 146, a stiffening plate structure 148, illustrated in FIGS. 7, 7A, and 10, and following the width dimension contour of the roof panel, is placed against the bottom surface of the respective roof panel at or adjacent the upper end of the aperture in the roof and extending up under the rib at rib mating surface 440. Self-drilling fasteners 430 (FIG. 7A) are driven through lower flange 410 and mating surface 440 of upper diverter 146, described more fully hereinafter, through the metal roof panel and into stiffening plate structure 148, drawing the diverter, the roof panel, and the stiffening plate structure into facing contact with each other and thus trapping the roof panel between the stiffening plate and the diverter and closing off the interface between the panel and the diverter. Thus, stiffening plate structure 148 acts as a nut for tightening fasteners 430. Caulk or other sealant can be used to further reinforce the closure/sealing of the diverter/roof panel interface.

Stiffening plate 148 also provides lateral support, connecting adjacent ribs 32 to each other. Stiffening plate 148 is typically steel or other material of sufficient substance, rigidity as to provide a rigid support to the upper diverter, as part of the load support structure at diverter 146.

Load support structure 100 is configured such that the skylight subassembly can be easily fastened directly to the side rails with rivets or other fasteners such as screws and the like as illustrated at 310 in FIG. 8D.

Looking now to FIGS. 7A, and 10 through 12, upper diverter 146 extends between rails 142, 144, and provides end closure, and a weather tight seal, of the load support structure, at the up-slope end of the roof aperture, and diverts water around the up-slope end of the aperture, to the flat portion 14 of an adjacent roof panel. Diverter 146 generally parallels the profile of the uncut rib 32 of the same roof panel across the panel flat overlaid by diverter 146 from the cut away diversion gap 122. The upper ends of side rails 142 and 144 abut the downstream side of diverter 146 and the height of diverter 146 closely matches the height of the side rails. Bearing panel 400 of diverter 146 thus acts with bearing panels 240 of side rails 142 and 144, and an upper surface of lower closure 150, to form the upper surface of the load support structure, to which the skylight lens frame 132 is mounted, as well as surrounding the space which extends upwardly from the corresponding aperture in the roof panel.

Lower flange 410 of diverter 146 runs along, and parallel to, panel flat 14 of the respective roof panel. Diverter 146 also has a diversion surface 420, and fastener holes 430 along lower flange 410. Diversion surface 420 is, without limitation, typically a flat surface defining first and second obtuse angles with lower flange 410 and intermediate end panel 415. As indicated in FIG. 10, diversion surface 420 has relatively greater width "W1" on the side of the closure structure which is against the rib which is not cut, and a relatively lesser width "W2", approaching a nil dimension, adjacent diversion gap 122, thus to divert water toward gap 122.

At the end of lower flange 410, which is closer to the closed rib, is rib mating surface 440. At the end of lower flange 410 which is closer to the cut rib is rib sealing portion 450 of the end panel 415, which functions as an end closure of the rib 32 on the down-slope side of diversion gap 122, and further functions to divert water across the respective rib 32 and onto the flat 14 portion of the roof panel. Rib sealing portion 450 extends through diversion gap 122 and across the respective otherwise-open end of the rib. Hard rubber rib plugs 460, along with suitable tape mastic and caulk or other sealants, are inserted into the cut ends of the rib on both the up-slope side and the down-slope side of the rib at diversion gap 122. The up-slope side plug, plus tube sealants, serve as the primary barrier to water entry on the up-slope side of diversion gap 122. Sealing panel portion 450 serves as the primary barrier to water entry on the down-slope side of diversion gap 122, with plug 460, in combination with tube sealant, serving as a back-up barrier.

The cross-section profiles of plugs 460 approximate the cross-section profiles of the cavities inside the respective ribs 32. Thus plugs 460, when coated with tape mastic and tube caulk, provide a water-tight closure in the upstream side of the cut rib, and a back-up water-tight closure in the downstream side of the cut rib. Accordingly, water which approaches upper diverter 146 is diverted by diversion surface 420 and flange 410 and secondarily by flange 415, toward sealing portion 450, thence through diversion gap 122 in the rib, away from the up-slope end of load support structure 100 and onto the flat portion of the next laterally adjacent roof panel. Accordingly, so long as the flow channel through diversion gap 122 remains open, water which approaches the skylight assembly from above upper diverter 146 is directed, and flows through, gap 122 and away from, and around, the respective skylight assembly.

Figure 11:
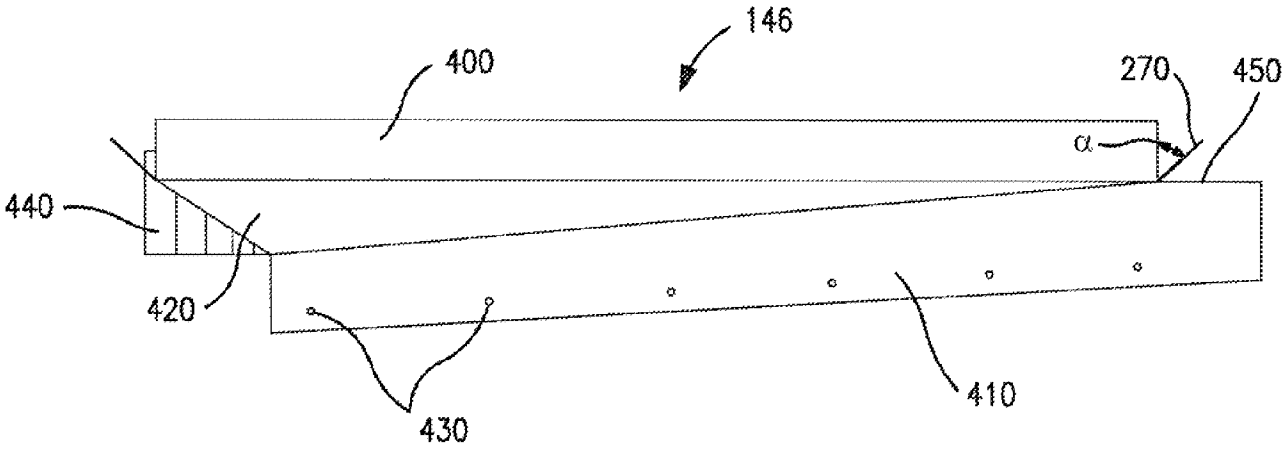
FIG. 11 is a top view of the upper diverter of FIG. 10 wherein trailing closure ears extend from the upstanding ends of the intermediate end panel and define acute angles with upright sides of respective side rails, before the trailing closure ears are closed over the upright sides of the side rails.
Figure 12:
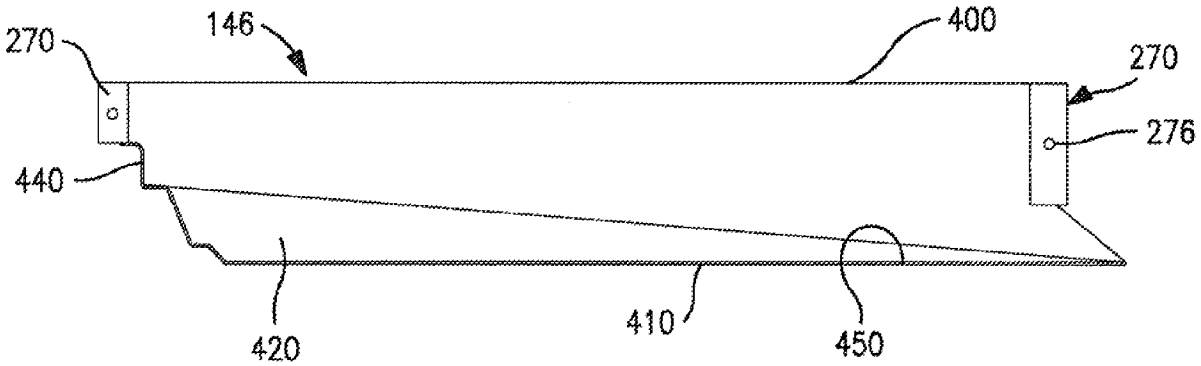
FIG. 12 is a front elevation view of the upper diverter.

FIGS. 7A, 10, and 11 show diverter ears 270 on opposing ends of the upper diverter. Ear 270 is shown in FIG. 11, in top view, at an acute angle $\alpha$ of about 45 degrees to the end of intermediate panel 415 of the diverter. FIG. 10 shows an ear 270 after the upper diverter has been assembled to a rail, and the ear has been bent flat against the respective outer web 238 of the rail. After the ear has been bent flat against the rail outer web, ear 270 is secured to outer panel 140 by driving a screw through aperture 276 and into the outer web.

Figure 13:
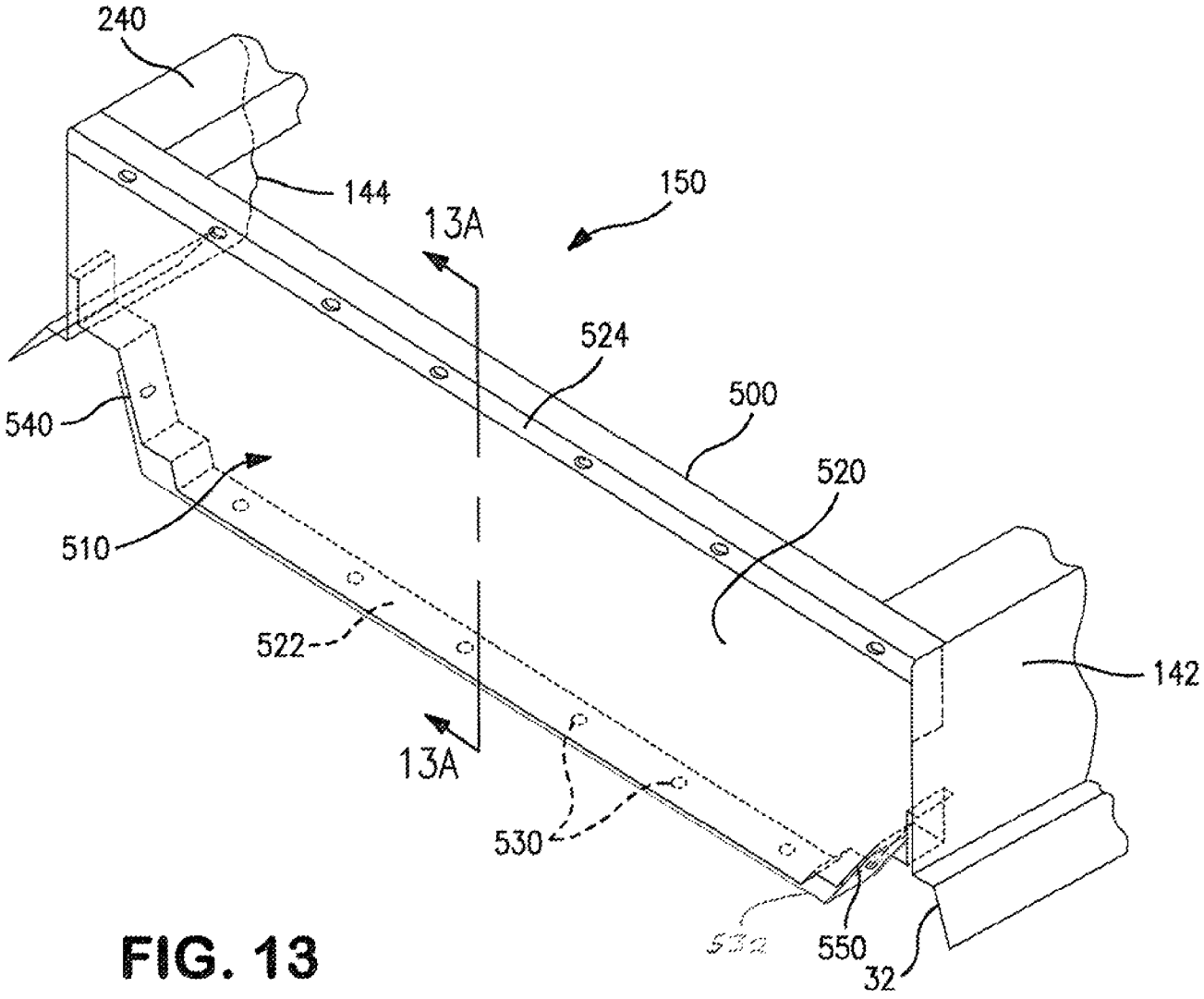
FIG. 13 is a perspective view of the lower closure and the corresponding underlying reinforcing plate.
Figure 15:
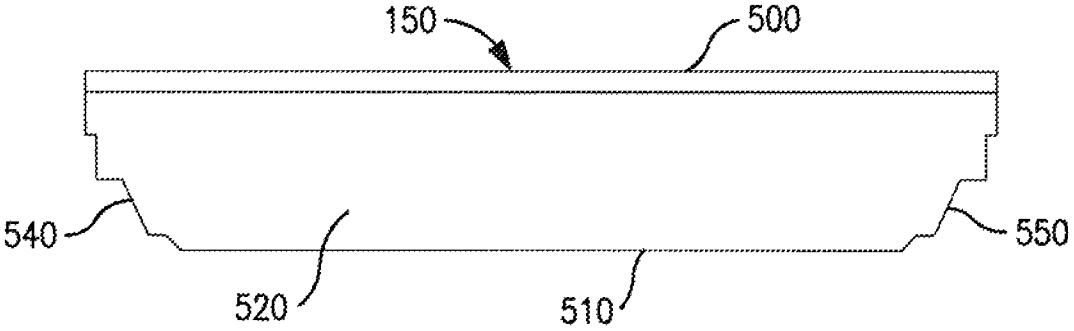
FIG. 15 is a front view of the lower closure.

FIGS. 9, 13, 13A, 14, and 15 show lower closure 150. The lower closure is used to establish and maintain a weather tight seal at the down-slope end of load support structure 100, namely at the down-slope end of roof aperture 249 (FIG. 8A). As illustrated in FIGS. 9, 13, and 15, the bottom of closure 150 is contoured to fit the profiles of ribs 32 as well as to fit the contour of panel flat 14. Bottom closure 150 abuts the lower ends of side rails 142 and 144, and the height of closure 150 matches the heights of side rails 142, 144.

Figure 13A:
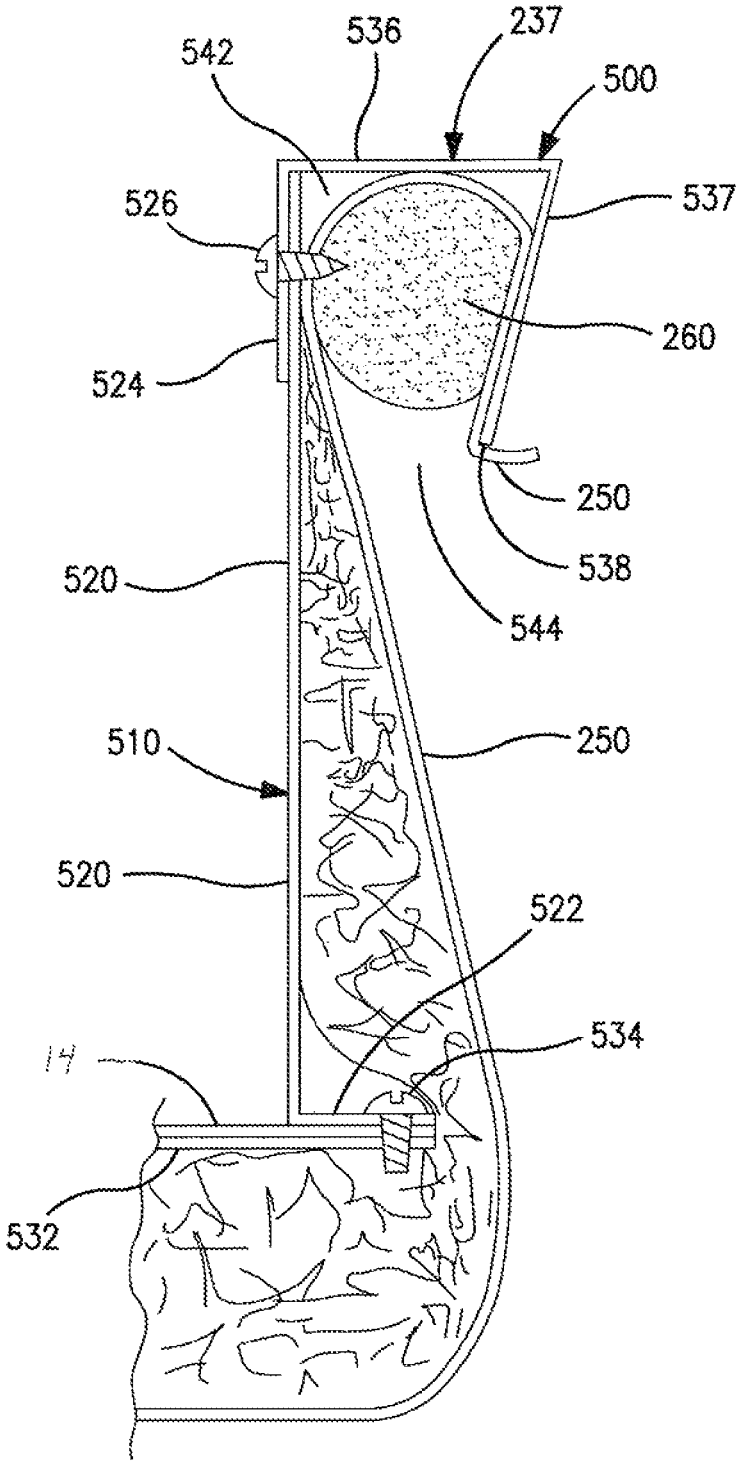
FIG. 13A is a cross-section taken at 13A-13A of FIG. 13, showing the relationships between the bottom portion of the lower closure and the overlying flange, showing the insulation facing sheet being held in the flange cavity by the thermally-insulating foam retainer rod, with the screws which mount the overlying flange to the bottom portion being embedded in the thermally insulating foam retainer rod, and showing the underlying reinforcing plate under the flat of the metal roof panel, whereby the joint between the bottom flange of the bottom portion of the lower closure and the flat of the roof panel is supported by the reinforcing plate.
Figure 14:
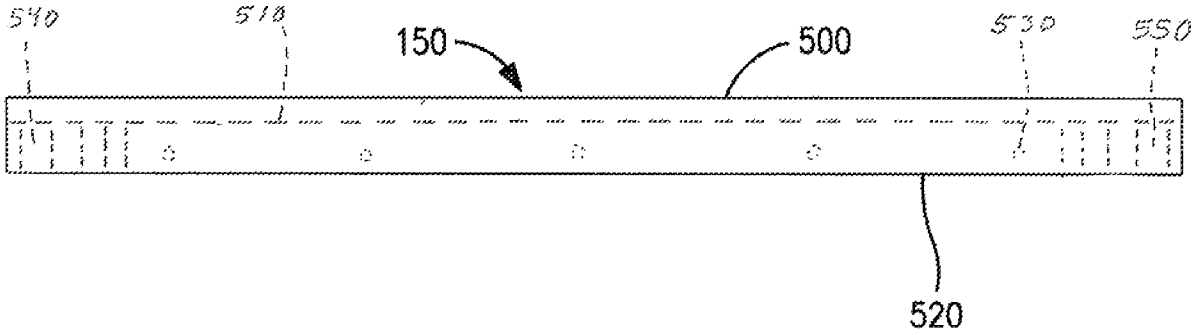
FIG. 14 is a top view of the lower closure.

Referring to FIGS. 13, 13A, lower closure 150 has a bottom portion 510 and an upper rail 500 secured to the bottom portion. Bottom portion 510 has a lower flange 522, as well as a closure web 520. Lower flange 522 is in-turned, namely flange 522 extends inwardly of closure web 520, toward the roof aperture and includes fastener holes 530. A stiff, e.g. steel, stiffener support plate 532 extends the width of the panel flat under lower flange 522. Self-drilling screws 534 extend through holes 530, through the panel flat, and into the stiffener support plate. Stiffener support plate 532 acts as a nut for the respective screws 534, whereby the screws can firmly secure the lower flange to the panel flat and provide support to that securement. Tube sealants can be used to enhance such closure.

Upper rail 500 is an elongate inverted, generally U-shaped structure. A first downwardly-extending leg 524 has a series of apertures spaced along the length of the rail, and screws 526 or other fasteners which extend through leg 524 and through closure web 520, thus mounting rail 500 to bottom portion 510.

Rail 500 extends, generally horizontally, from leg 524 inwardly and across the top of closure web 520, along bearing panel 536 to inside panel 537. Inside panel 537 extends down from bearing panel 536 at an included angle, between panels 536 and 537, of about 75 degrees to a lower edge 538.

Thus, the upper rail of the lower closure, in combination with the upper region of closure web 520, defines a cavity 542 which has a cavity cross-section corresponding with the cross-sections of cavities 264 of rails 142, 144. As with cavities 264 of the side rails, foam retaining rod 260 has been compressed in order to force the rod through slot 544, capturing and holding the facing sheet 250 between the retaining rod and the surfaces which define cavity 542. The facing sheet has been raised. Facing sheet 250 traverses cavity 542 along a path similar to the path through cavities 264 of the side rails. Thus, facing sheet 250 enters cavity 542 against the inner surface of closure web 520, extends up and over/about rod 260 in the cavity, against panels 536 and 537, and back out of cavity 542 to a terminal end of the facing sheet outside cavity 542. The tension on facing sheet 250 holds edge portion 256 of the batting against bottom portion 510 of the lower closure.

The uncompressed, rest cross-section of rod 260 in cavity 542 is somewhat greater than the cross-section of slot-shaped opening 544 between inside panel 537 and closure web 520, whereby rod 260 is compressed while being inserted through slot 544 and into cavity 542. After passing through opening 544, rod 260 expands against panels 524, 536, and 537 of the cavity while remaining sufficiently compressed to urge facing sheet 250 against panels 524, 536, and 537 whereby facing sheet 250 is assuredly retained in cavity 542.

As an alternative, panel 537 can be resiliently deflectable whereupon rod 260 need not be compressible.

As with screws 300 which mount the skylight assembly to side rails 142, 144, upper diverter 146, and lower closure 150, screws 526 extend through rail 500, through closure web 520, and into rod 260, whereby rod 260 insulates the inside of the roof aperture from temperature differentials transmitted by screws 526, thereby to avoid the fasteners being a source of condensation inside space 274 below the skylight lens.

Upper rail 500 of the lower closure extends inwardly of closure web 520 at a common height with bearing panels 240 of the side rails. Collectively, the bearing panels of side rails 142, 144, lower closure 150, and upper diverter 146 form a common top surface of the rail and closure structure, which receives the skylight lens subassembly.

Closure 150 includes rib mating flanges 540 and 550, as extensions of lower flange 522, to provide tight fits and stiffness/rigidity between the adjoining along ribs 32.

A salient feature of load support structures 100, relative to conventional curb-mounted skylights, is the reduction in the number of roof penetrations, namely roof apertures, required to provide daylight lighting to the interior of e.g. a building, as multiple skylight assemblies can be mounted along the length of a single elongate aperture in the roof, whereby fewer, though longer, apertures can be made in the roof. Namely, a single opening in the roof can extend along substantially the full length of a roof panel, if desired, rather than cutting multiple smaller openings along that same length, and wherein the single aperture can provide for an equal or greater quantity of ambient light being admitted into the building through a smaller number of roof apertures.

Another salient feature of load support structures 100, relative to conventional curb-mounted skylights, is the fact that the full lengths of the entireties of the sides, namely the side rails, are above the panel flats, namely above the water lines of the respective metal roof panels.

Yet another salient feature of load support structures 100, relative to conventional curb-mounted skylights, is the provision of lateral leg 147 of the upper diverter, which diverts water laterally away from the upper end of the skylight installation/load support structure.

Figure 16:
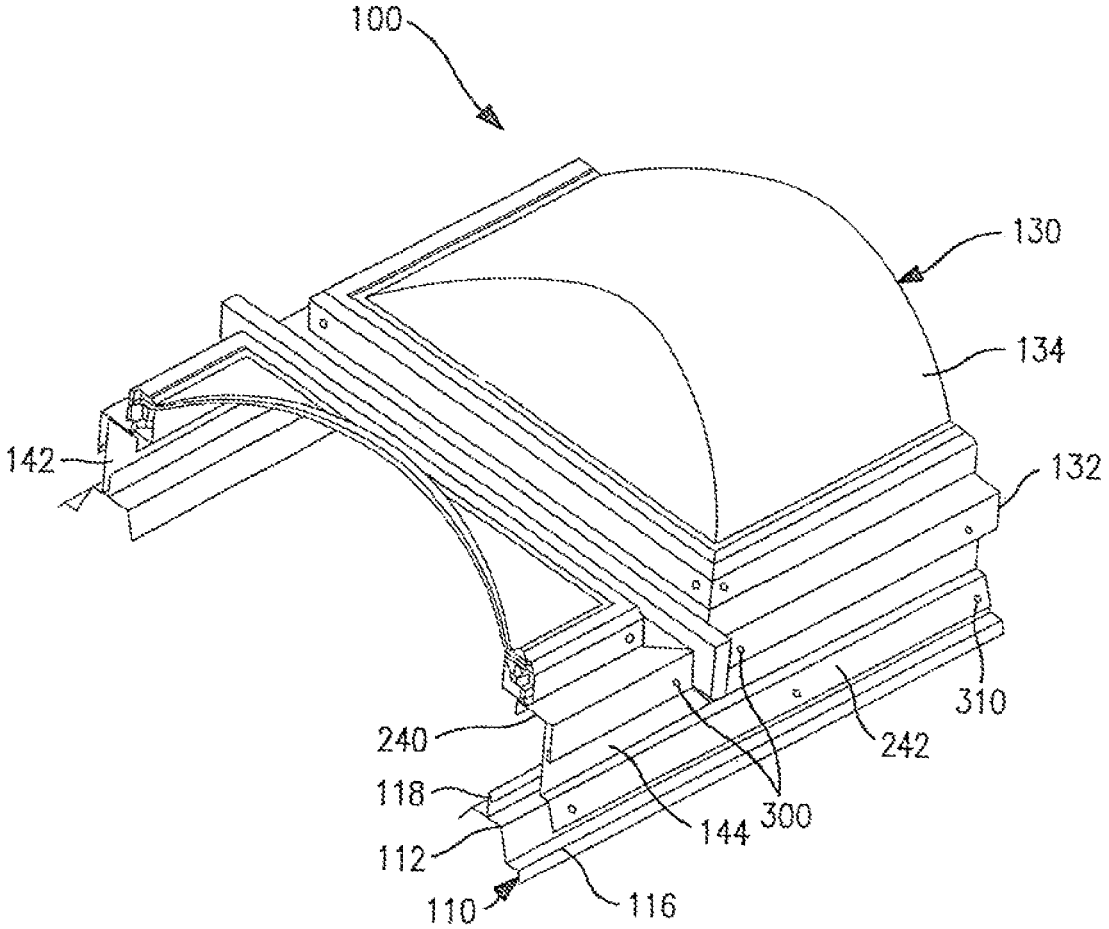
FIG. 16 is a perspective view, partially cut away, showing an end joint between facing ends of adjacent skylights of the system.
Figure 17:
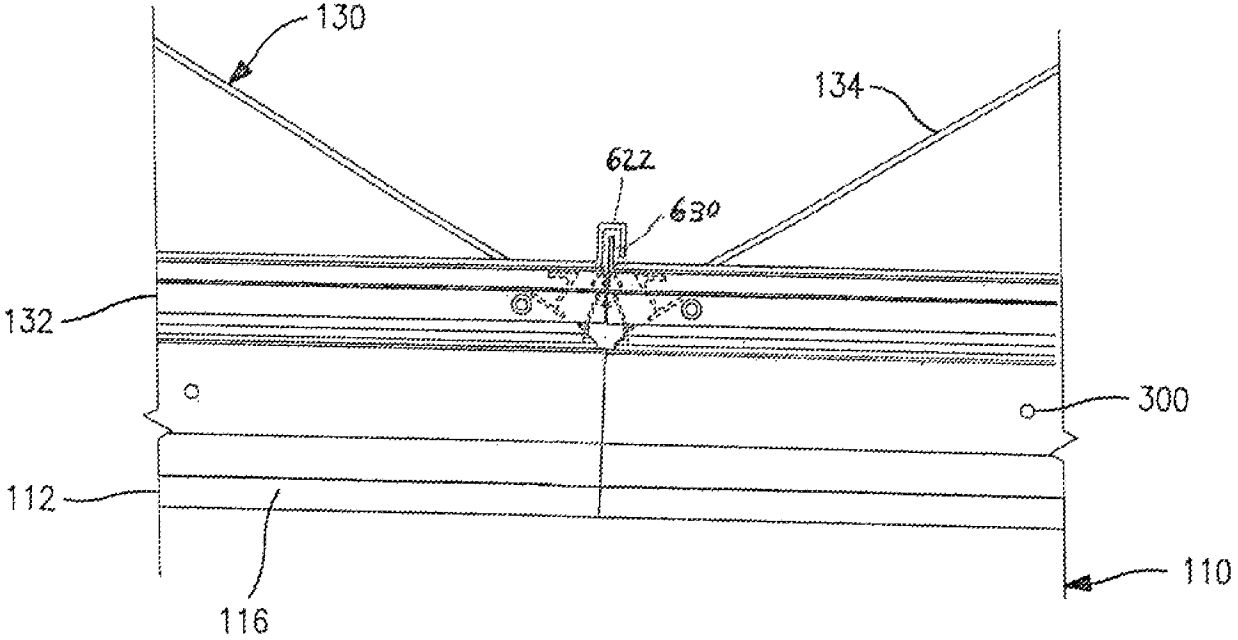
FIG. 17 shows additional detail of the joint between facing ends of adjacent skylights.

Load support structures of the invention are particularly useful for continuous runs of e.g. skylights, where individual skylights are arranged end to end between the ridge and the eave of a roof. FIGS. 16 and 17 show how the ends of two adjacent skylight assemblies can be joined to each other as a strip of such skylight assemblies. Instead of installing an upper diverter and a lower closure with each of multiple skylight assemblies, rail 142A under the relatively up-slope skylight abuts rail 1428 under the relatively down-slope skylight, rails 142A, 144A being mounted by rail shoulders 242A, 242B to rib 32. A female mating strip 622 extends across aperture 249 at the relatively down-slope ends of a first pair of rails 142, 144, between rail 142A and the corresponding rail 144 on the other side of the aperture as part of the down-slope end of the up-slope skylight assembly, illustrated in FIG. 17.

A male mating strip 630 extends across aperture 249 at the relatively up-slope ends of a second pair of abutting rails 142B and a corresponding opposing rail 144, on the other side of the aperture as part of the up-slope end of the down-slope skylight assembly illustrated in FIG. 17.

Female mating strip 622 has a generally vertically oriented elongate receptacle/slot. Male mating strip 630 has a generally vertically oriented elongate protuberance. Male mating strip 630 is received in female mating strip 622 whereby the male and female mating strips define the joint across aperture 249, thus joining the up-slope and down-slope skylight assemblies to each other. A bead of tube sealant is laid in female receptacle 632 before the male protuberance is mated with receptacle 632. Additional tube sealant is applied along the joint as appropriate.

In the process of installing the closure support structure, the upper diverter is installed first, after cutting a small portion of the aperture 249 near where upper diverter 146 is to be installed. Then the remainder of aperture 249 is cut in the respective roof panel and the rails are installed. The lower closure is then installed, which defines the perimeter of the surrounded space, and the bearing surfaces of the load support structure. The skylight assemblies are then mounted on the perimeter bearing surfaces and secured to the rails. Tube sealant and tape mastic are applied, as necessary, at the respective stages of the process to achieve leak-free joints between the respective elements of the skylight system.

Skylight assemblies of the invention can be connected end to end for as long a distance as necessary to cover a roof aperture, as each skylight assembly unit is supported by the ribs 32 of the respective roof panel through respective rails 142, 144. The standing rib elevations extend longitudinally along the full collective lengths of the respective rails, regardless of the number of skylight assemblies which are used to close off a given aperture in the roof. Water cannot enter over the tops of the rails because of the sealant at 330. Water cannot enter at the upper diverter at the most up-slope skylight assembly because of the seal properties provided by the upper diverter, by bearing plate 148, and by the respective sealants, as well as because of the diversion of water away from the upper end of the strip of skylights through diversion gap 122. Water cannot enter at the lower end because of the seal properties provided by the lower closure and by the sealants between the lower closure and the respective roof panel. Water cannot enter between the ends of the skylight subassemblies because of the tortuous path through female receptacle 622 in combination with the sealants applied at the end-to-end joint.

Figure 18:
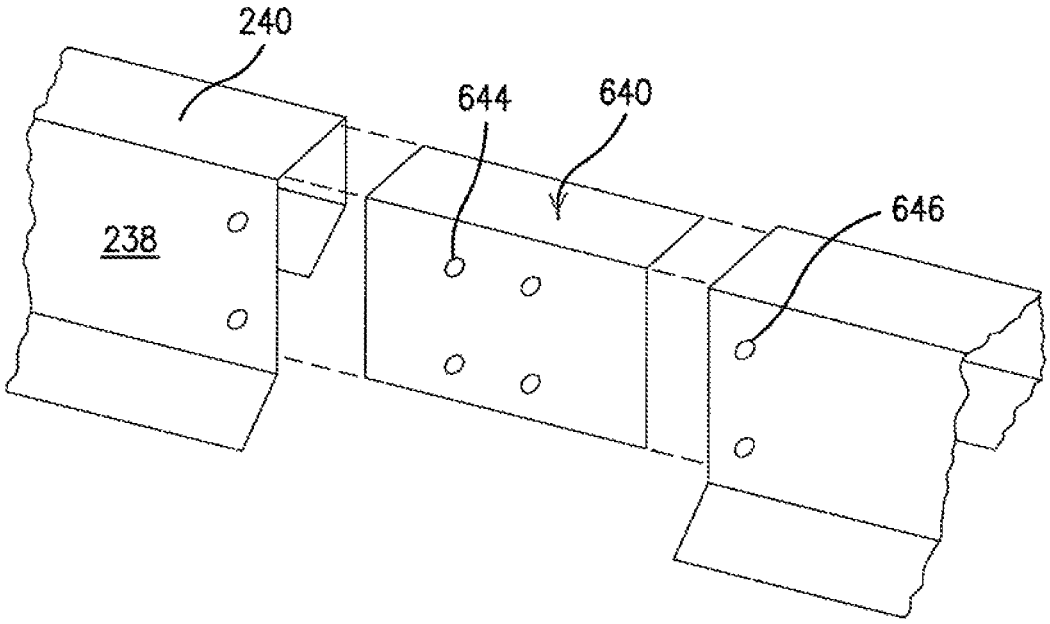
FIG. 18 shows an exploded pictorial view of a rail connector aligned with abutting rail ends and wherein the connector bridges the butt joint between rails which adjoin each other end to end.

FIG. 18 shows an exploded pictorial view of the ends of first and second rails in abutting relationship, which abutting relationship is also illustrated in part in FIG. 17, such as where first and second skylights are arranged in end-to-end relationship over a common roof aperture. Connector 640 is configured to fit closely inside the cavity cross-sections defined by the respective rails, against the outer rail webs 238 and against the rail bearing panels 240. Connector 640 is shown aligned with the abutting rail ends. The connector is inserted into the cavities in the rails, bridging the butt joint between the rails. Apertures 644 in the connector align with apertures 646 in the rails when the ends of the rails are in abutting relationship. Screws, bolts, rivets, or other known aperture-to-aperture fasteners are used to securely fasten connector 640 to both of the rails. Tape mastic and tube caulk are used, as known in the art for water seal closures, to fill the joint between the rail panels and the reinforcing connector. Connector 640 thus both provides reinforcement of the joint and enhances seal of the joint against intrusion of water.

The side rail profiles described so far can all illustrate securing the side rail to the underlying roof rib at a sloping side wall of the rib. Each of such elongate side rails can be fabricated by cutting and bending a single piece of sheet metal stock to form such side rails. Such side rail may be e.g. ten (10) feet long. An elongate upstanding web 238 has a top and a bottom. A lower shoulder 242 extends, as a first shoulder element, perpendicular to the bottom of the upstanding web as an extension of the web material. A second shoulder element may extend down and laterally away from a distal edge of the first shoulder element. Fasteners, such as rivets 310, may be spaced along the length of the side rail and secure the side rail to the underlying roof rib. A bearing panel 240 extends laterally from the top of upstanding web 238. An inside panel 244 extends downwardly from the distal edge of bearing panel 240. Web 238, in combination with panels 240 and 244 define rail cavity 264.

FIGS. 19A-19E, and 19I illustrate additional exemplary side rail structures which can be secured directly to the upstanding seam of the underlying rib structure. Certain ones of such examples can in addition, be secured to the sloping side wall of the rib.

Certain ones of the side rails can be fabricated by extruding the respective profiles, typically using aluminum or aluminum alloy as the material of choice.

Figure 19A:
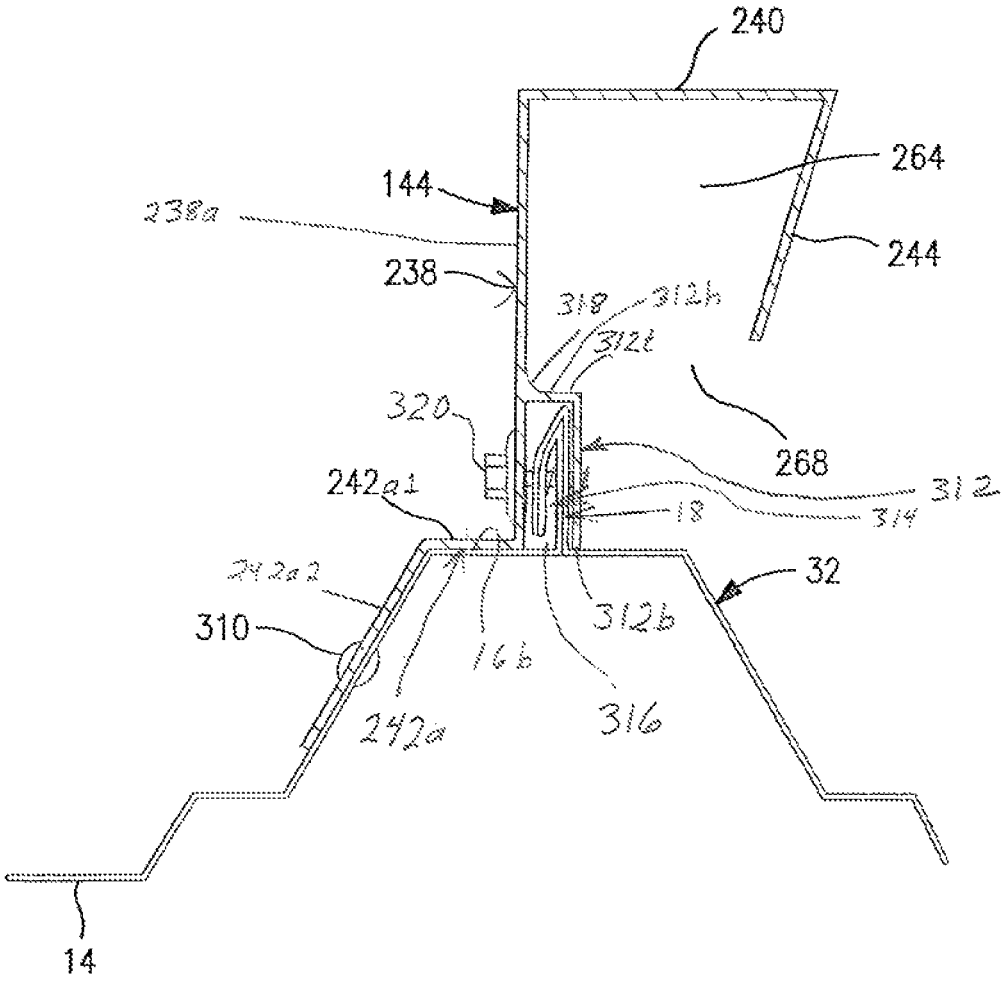
FIG. 19A is an end/profile view of a first, optionally extruded, side rail having a seam cavity mounted over, and secured to, the upstanding side seam of a rib, where a shoulder of the side rail extends down the outside of the rib.
Figure 19B:
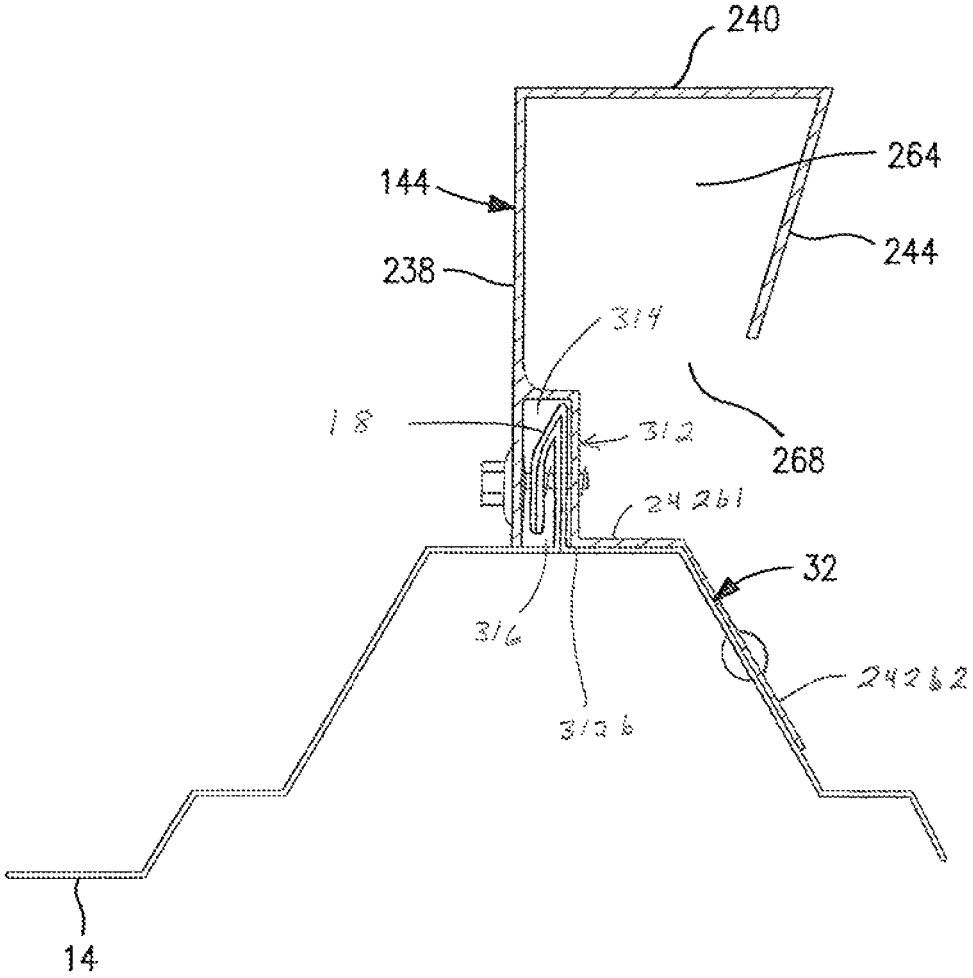
FIG. 19B is an end/profile view of a second, optionally extruded, side rail having a seam cavity mounted over, and secured to, the upstanding side seam of a rib, where a shoulder of the side rail extends down the inside of the rib.
Figure 19C:
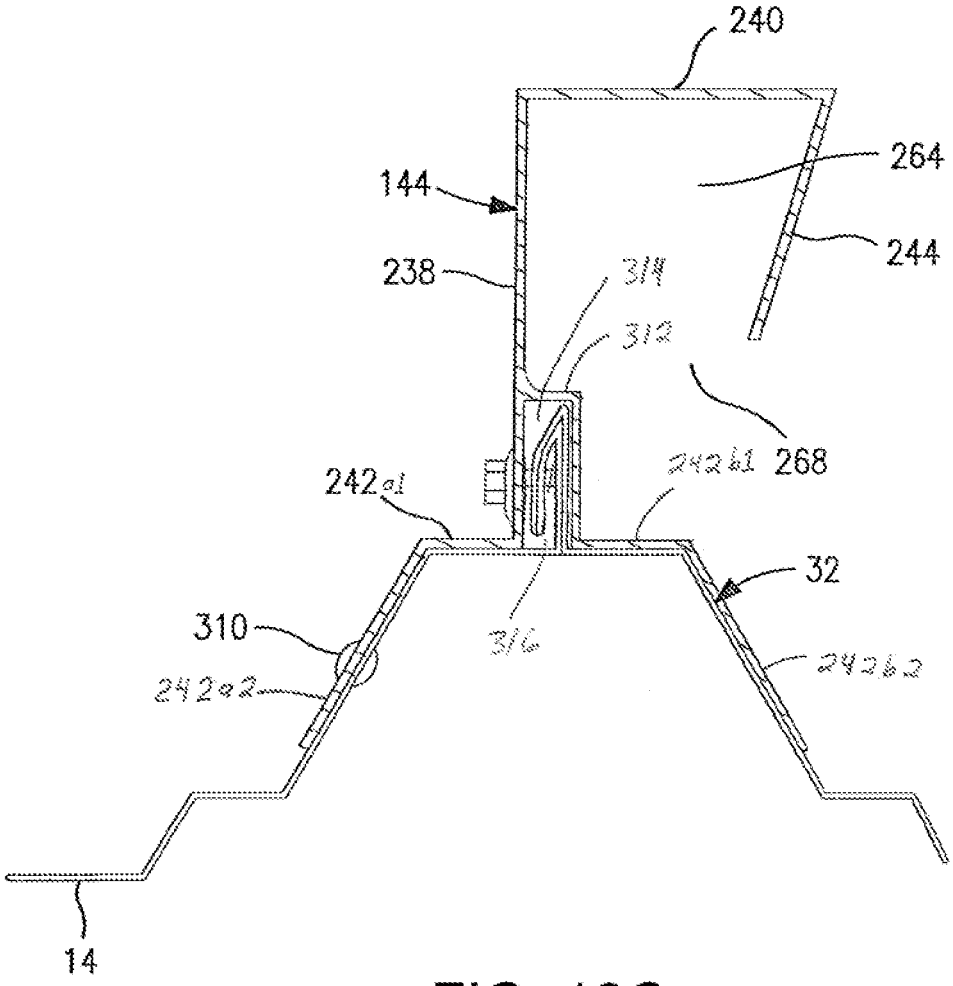
FIG. 19C is an end/profile view of a third, optionally extruded, side rail having a seam cavity mounted over, and secured to, the upstanding side seam of a rib, where first and second shoulders of the side rail extend down on opposing sides of the rib.
Figure 19D:
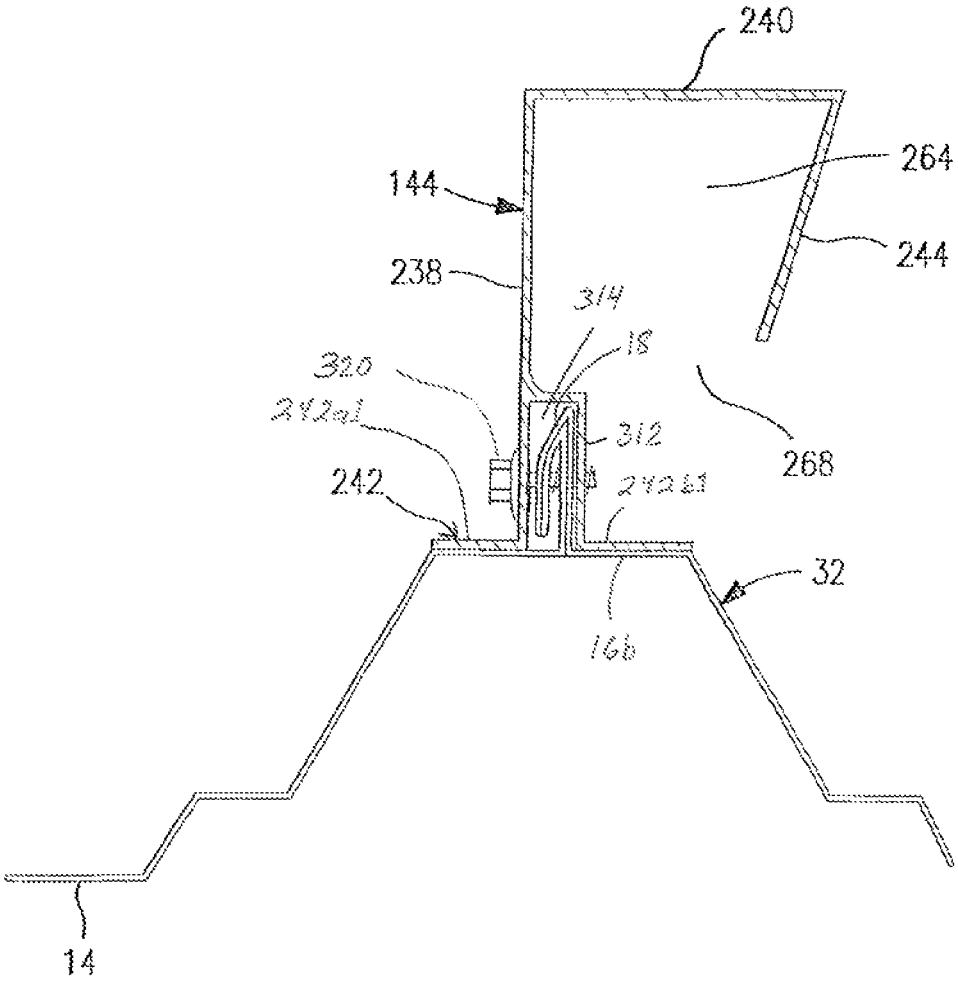
FIG. 19D is an end/profile view of a fourth, optionally extruded, side rail having a seam cavity mounted over, and secured to, the upstanding side seam of a rib, where first and second shoulders of the side rail extend laterally, perpendicularly, away from opposing sides of the seam cavity.
Figure 19E:
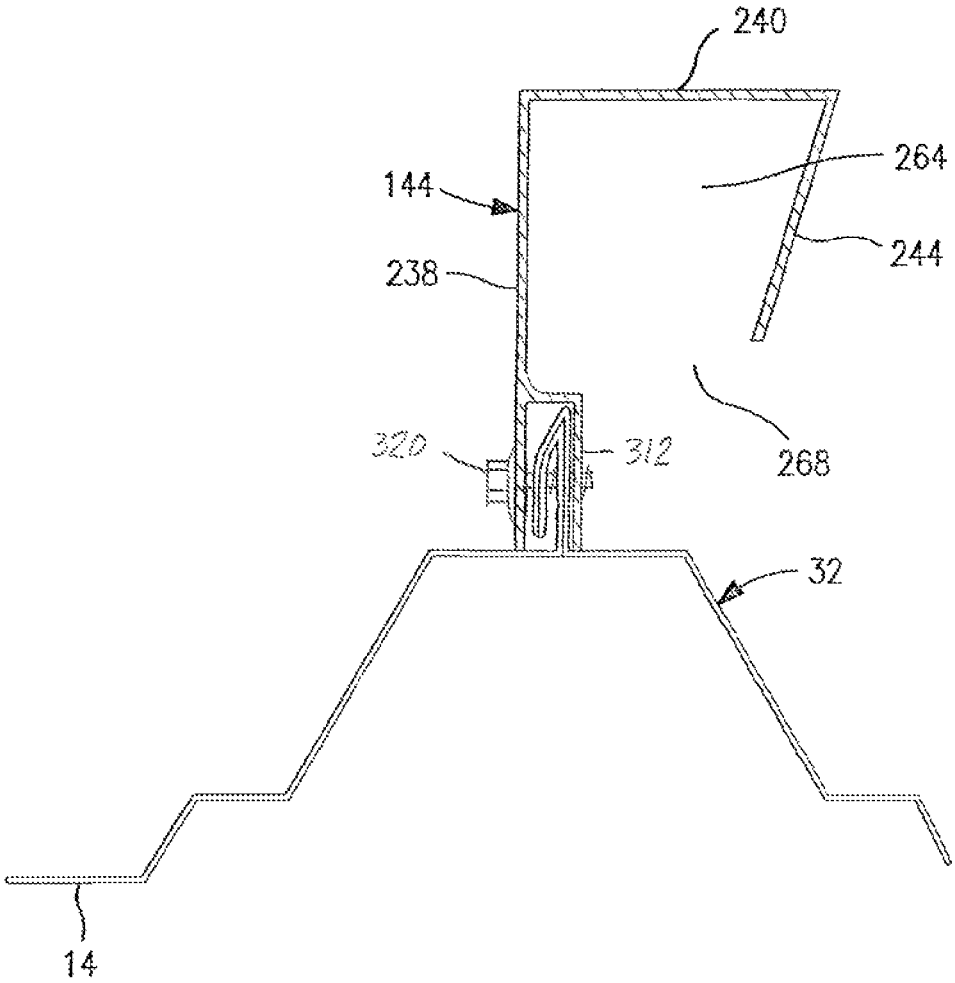
FIG. 19E is an end/profile view of a fifth, optionally extruded, side rail having a seam cavity mounted over, and secured to, the upstanding side seam of a rib, where no shoulders extend laterally away from the sides of the seam cavity.
Figure 19F:
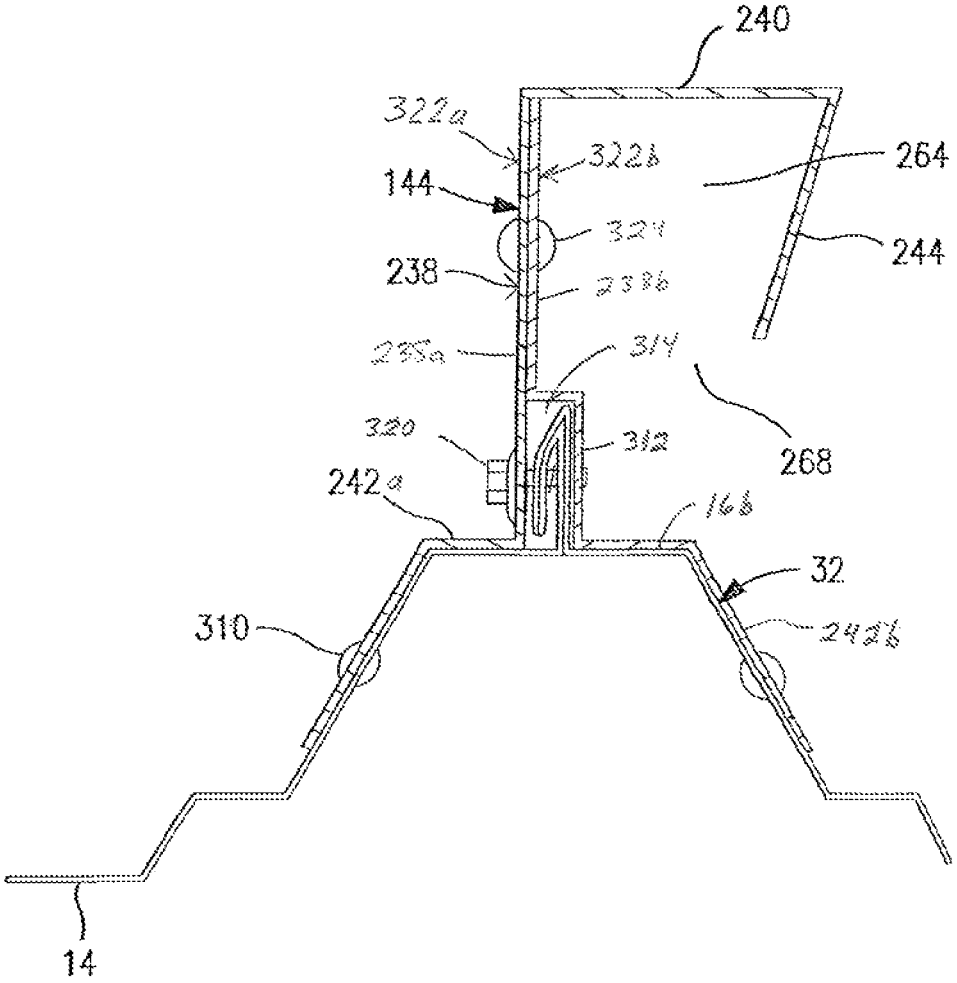
FIG. 19F is an end/profile view of a sixth side rail of the invention having a seam cavity mounted over, and secured to, the upstanding side seam of a rib, where the rail is fabricated using first and second formed sheet metal parts, each forming part of the cavity enclosure, and each having a dependent lower shoulder.
Figure 19G:
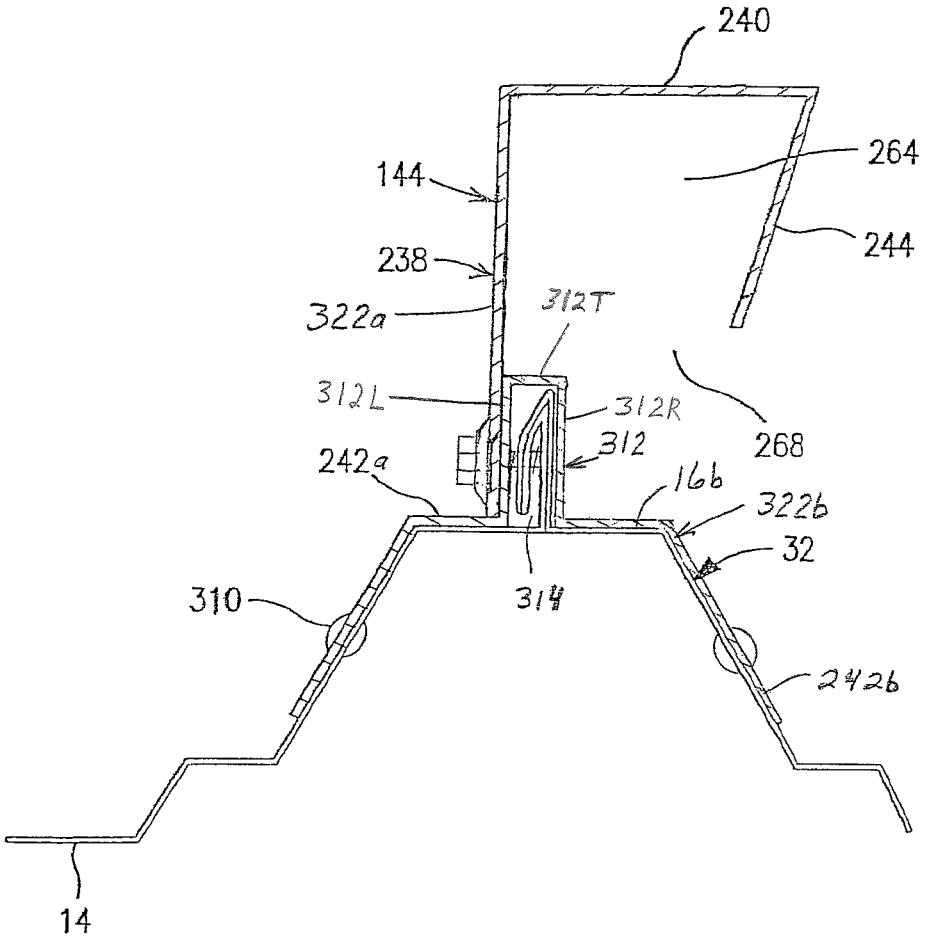
FIG. 19G is an end/profile view of a first two-piece side rail as in FIG. 19F, but where one of the two pieces defines the entirety of the seam cavity and both of the first and second lower rail shoulders.
Figure 19H:
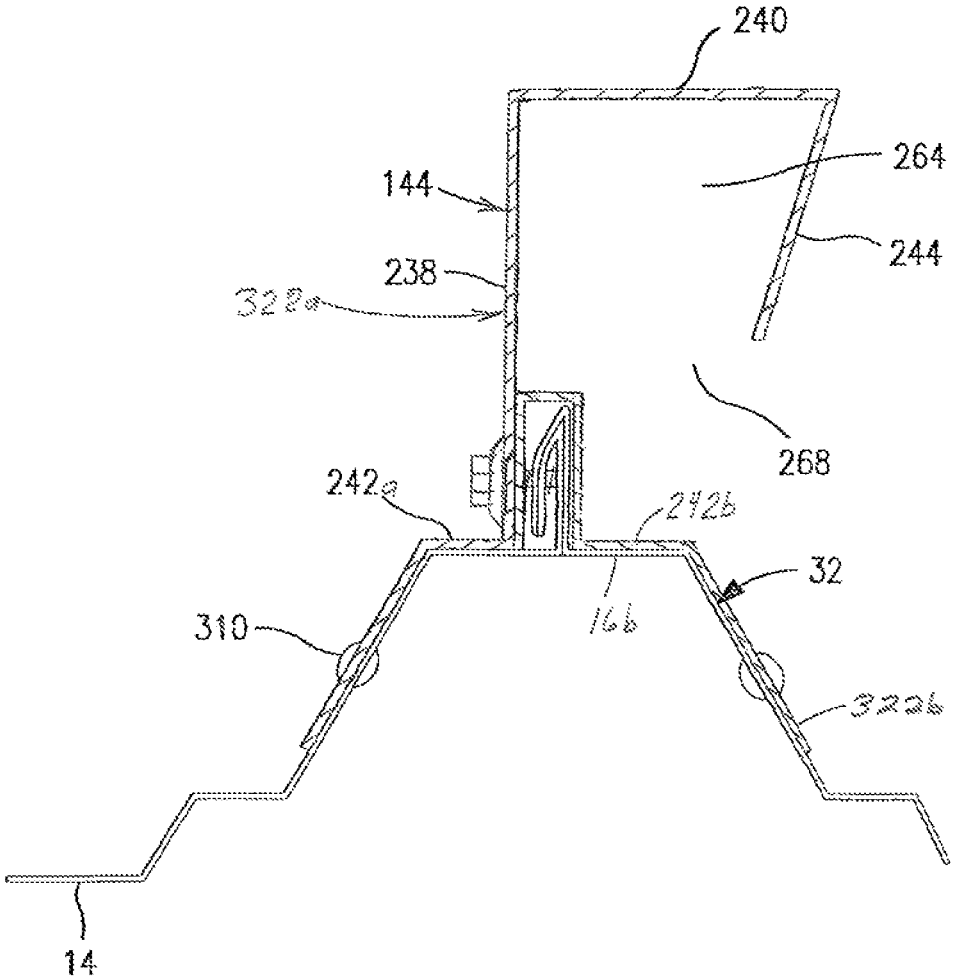
FIG. 19H is an end/profile view of a second two-piece side rail as in FIG. 19G, but where each of the two pieces define one of the lower shoulders.

FIGS. 19F-19H illustrate side rails having similar overall profiles, but wherein the side rails can be made by cutting and bending first and second elongate side rail elements/piece parts from sheet metal stock and subsequently joining the first and second elements/piece parts to each other or by extrusion.

All of the side rails illustrated in FIGS. 19A-19I share a common element whereby a bottom-opening cavity overlies, and receives, the upstanding seam 18 of the underlying roof rib, and the respective side rail is secured to the upstanding rib seam by mechanical fasteners spaced along the length of the side rail. Exemplary of such fasteners are TEK #12-14 SS self-drilling screws. Such screw engages at least one wall of the cavity as well as the folded-over elements of the standing seam 18. In implementation of certain ones of such embodiments, the side rail is also secured to the underlying roof rib at a sloping side wall of the rib such as by screws or rivets.

FIG. 19A is illustrative. A single-piece side rail 144 is fabricated by a conventional metal extrusion process. The side rail 144 of FIG. 19A has an elongate upstanding web which has a top at an upper end of the web. In FIG. 19A, a bottom of web 238 is located at the top of rib shoulder flat 16*b*. An intermediate portion 238*a* of web 238 is disposed between the top and the bottom of the web.

Rail lower shoulder 242*a* extends from the bottom of web 238. Lower rail shoulder 242*a* extends as a first shoulder panel 242*a*1 perpendicular to web 238. A second shoulder panel 242*a*2 extends laterally and downwardly from the distal end of first shoulder panel 242*a*1.

An elongate upstanding cavity wall 312 is displaced from, and extends parallel to, upstanding web 238. Cavity wall 312 has a bottom 312*b* located at the top of shoulder flat 16*b*, thus at an elevation equal to the elevation of the bottom of web 238, and on an opposing side of standing seam 18 from rail shoulder 242*a*. Cavity wall 312 further has a top 312*t* remote from bottom 312*b*. Wall 312 has an upstanding element between bottom 312*b* and top 312*t*; and the top of the cavity wall defines a horizontal element 312*h* of the cavity wall which extends from the upstanding element laterally toward, and makes a unitary connection with, upstanding web 238 at the intermediate portion of the upstanding web. Thus an upper portion of the cavity wall is connected to the intermediate portion of upstanding web 238. The locus of joinder 318 between the cavity wall and web 238 is reinforced by providing a radius at the joinder between web 238 and wall 312 which provides an enhanced thickness compared to the overall average thickness of web 238 and wall 312. Thus, for example, the thicknesses, of web 238 and wall 312 may be e.g. 006 inch, while the maximum thickness dimension taken at the 45 degree location of the radius between the joined elements, can be e.g. and without limitation, 0.09 inch, or greater. The purpose of the enhanced thickness is to reinforce a potentially weak spot in the side rail profile. Those skilled in the art will be able to identify appropriate reinforcement designs for their specific side rail profiles.

The collective cross-section profiles of upstanding web 238 and cavity wall 312 thus define an elongate standing seam cavity 314 which extends substantially the full length of the respective side rail. The left side of cavity 314 is defined by web 238. The right and top sides of cavity 314 are defined by cavity wall 312. The bottom of cavity 314 is open and thus provides an entrance/access path into the cavity.

Side rail 144 is mounted to rib 32 by positioning side rail 144, in an upright orientation as oriented in FIG. 19A, over the respective rib 32 with the cavity opening 316 positioned directly over the standing seam. The rail is then lowered onto the standing seam. TEK screws 320 as illustrated above are then driven through upstanding web 238 into the cavity, into and through the folded-over elements of the standing seam, and into and through cavity wall 312. Such fasteners are effective to draw the respective elements tightly to each other, thus providing solid securement of the side rail to the standing seam. Additional securement, and lateral stability of the side rail, can be obtained by also securing the side rail to the rib by installing e.g. rivets 310 through the second shoulder panel 242*a*2 and spaced along the length of the side rail.

The side rail shown in FIG. 19B is similar to that of FIG. 19A except that lower shoulder 242*b* extends from the bottom 312*b* of cavity wall 312 rather than from the bottom of upstanding web 238. Thus, a first shoulder panel 242*b*1 extends from the bottom 312*b* of cavity wall 312, and a second shoulder panel 242*b*2 extends from the distal end of shoulder panel 242*b*1.

The side rail shown in FIG. 19C is similar to that of FIGS. 19A and 19B except that a first lower shoulder 242*a* extends from the bottom of upstanding web 238 and a second lower shoulder 242*b* extends from the bottom of cavity wall 312. Thus, a first shoulder panel 242*a*1 extends from the bottom of upstanding web 238 and a second shoulder panel 242*a*2 extends from the distal end of shoulder panel 242*a*1. A shoulder panel 242*b*1 extends from the bottom of cavity wall 312, and a shoulder panel 242*b*2 extends from the distal end of shoulder panel 242*b*1. Shoulder panel 242*a*2 is secured to the underlying rib by rivets 310. Shoulder panel 242*b*2 is not so secured but could as well be secured to the underlying rib by additional rivets 310.

The side rail shown in FIG. 19D is similar to that shown in FIG. 19C except that only the shoulder panels 242*a*1 and 242*b*1 are used. Neither shoulder panel is secured to the underlying rib, whereby the only securement of the side rail to the rib is by the TEK screws 320 which extend through upstanding web 238 into seam cavity 314, through the upstanding web 18 and into cavity wall 312. However, shoulder panels 242*a*1 and 242*b*1 do bear on the top of shoulder 16*b* of the rib, thus providing stabilizing leverage to the side rail from the top of the rib.

The side rail shown in FIG. 19E is similar to that shown in FIG. 19D except that no shoulders are used. Rather, the bottom of cavity wall 312 and the bottom of web 238 collectively define the bottom of the side rail whereby screws 320 provide the complete attachment of the side rail to the rib.

The side rail shown in FIG. 19F departs from the structures of FIGS. 19A-19E in that the side rail 144 is defined by a first side rail element 322*a* and *a* second side rail element 322*b*. Side rail element 322*a* extends from a lower shoulder 242*a* up through an upstanding web element 238*a*, and continues through bearing panel 240 and inside panel 244, and defines the left side of cavity 314. Side rail element 322*b* extends from a lower shoulder 242*b* up through cavity wall 312, and thence from the top of the cavity wall further extends up alongside web element 238*a* as a second web element 238*b*. Web elements 238*a* and 238*b* are secured to each other by rivets 324 above the top of the cavity and spaced along the length of the side rail. Each of the shoulders is secured to the underlying ribs by rivets 310 spaced along the length of the side rail. The side rail elements 322*a* and 322*b* are further secured to each other by TEK screws 320 which connect the respective rail elements and the standing seam 18 to each other through cavity 314.

The side rail shown in FIG. 19G is similar to the embodiments of FIG. 19F in that the side rail is defined by first and second side rail elements 322*a* and 322*b*. However, in FIG. 19G, rail element 322*b* extends, as cavity wall 312, up and over cavity 314, thus from shoulder 242*b* up along the right side of cavity 314 as a first cavity side wall 312R, across the top of cavity 314 as a top wall 312T, and thence downwardly defining the left side of the cavity, as a second side wall 312L, to the left side of the top of rib shoulder 16*b*. Cavity walls 312R, 312T, and 312L collectively define a cavity ridge which confines the downwardly-open cavity. Rail element 322*b* extends, from the bottom of wall element 312L, laterally away from the standing seam as shoulder 242*a* of the rib. As seen in FIG. 19G, a lower portion of rail element 322*a* extends, as a lower portion of upstanding web 238, from the top of shoulder 242*a* alongside, and in contact with, rail element 322*b*, as second side wall 312L, at the left side of cavity 314, below the top of the cavity, and an upper portion of upstanding web 238 extends above top wall 312T. Rail element 322*a* extends up to the top of the web, thence laterally as bearing panel 240 and thence downwardly as inside panel 244. Rail elements 322*a* and 322*b* are joined to each other by TEK screws 320 which connect the respective rail elements and the standing seam 18 to each other through cavity 314. Rail element 322*b* is further secured to the underlying rib by rivets 310 spaced along the length of the side rail, on both sides of the standing seam.

The side rail shown in FIG. 19H is similar to the embodiments of FIG. 19G in that the side rail is defined by first and second side rail elements 322*a* and 322*b*. However, in FIG. 19H, that portion of rail element 322*b* which defines the left side of cavity 314 stops at the bottom of the cavity, in abutting relationship with the top of rib shoulder 16*b*. Rather, rail element 322*a* extends, from the elevation at the bottom of cavity 314, laterally away from the standing seam as shoulder 242*a* and upwardly to bearing panel 240, thence downwardly as inside panel 244. Rail elements 322*a* and 322*b* are joined to each other by TEK screws 320 which connect the respective rail elements and the standing seam 18 to each other through cavity 314. Rail elements 322*a* and 322*b* are both further secured to the underlying rib by rivets 310 spaced along the length of the side rail, on both sides of the standing seam.

Figure 19I:
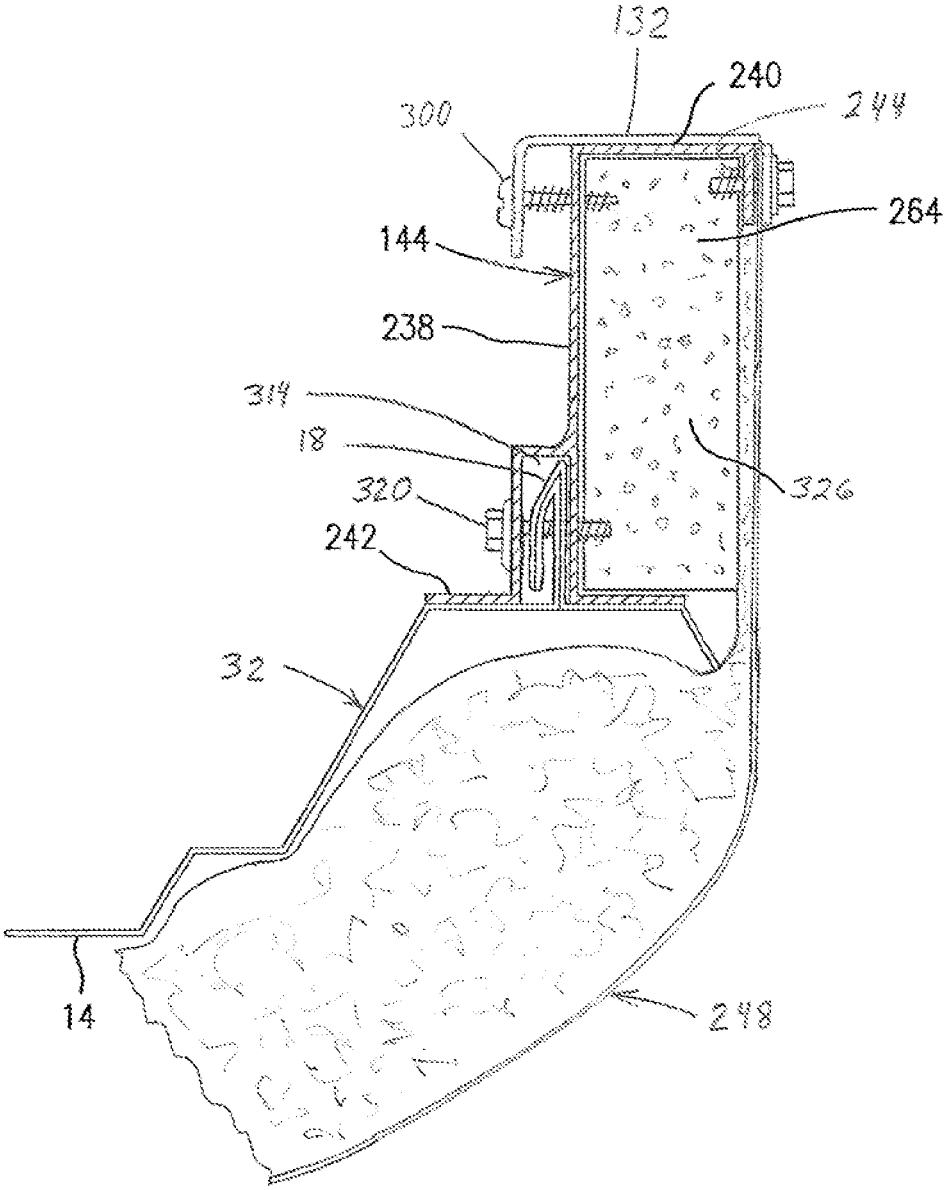
FIG. 19I is an end/profile view of a seventh, optionally extruded, side rail having a seam cavity mounted over, and secured to, the upstanding side seam of a rib, also showing a portion of a skylight assembly frame, where an elongate block of relatively rigid insulation is disposed in an upper rail cavity, and an edge of the underlying building roof insulation extends up alongside the block of insulation and is secured to an inner web of the side rail.
Figure 19J:
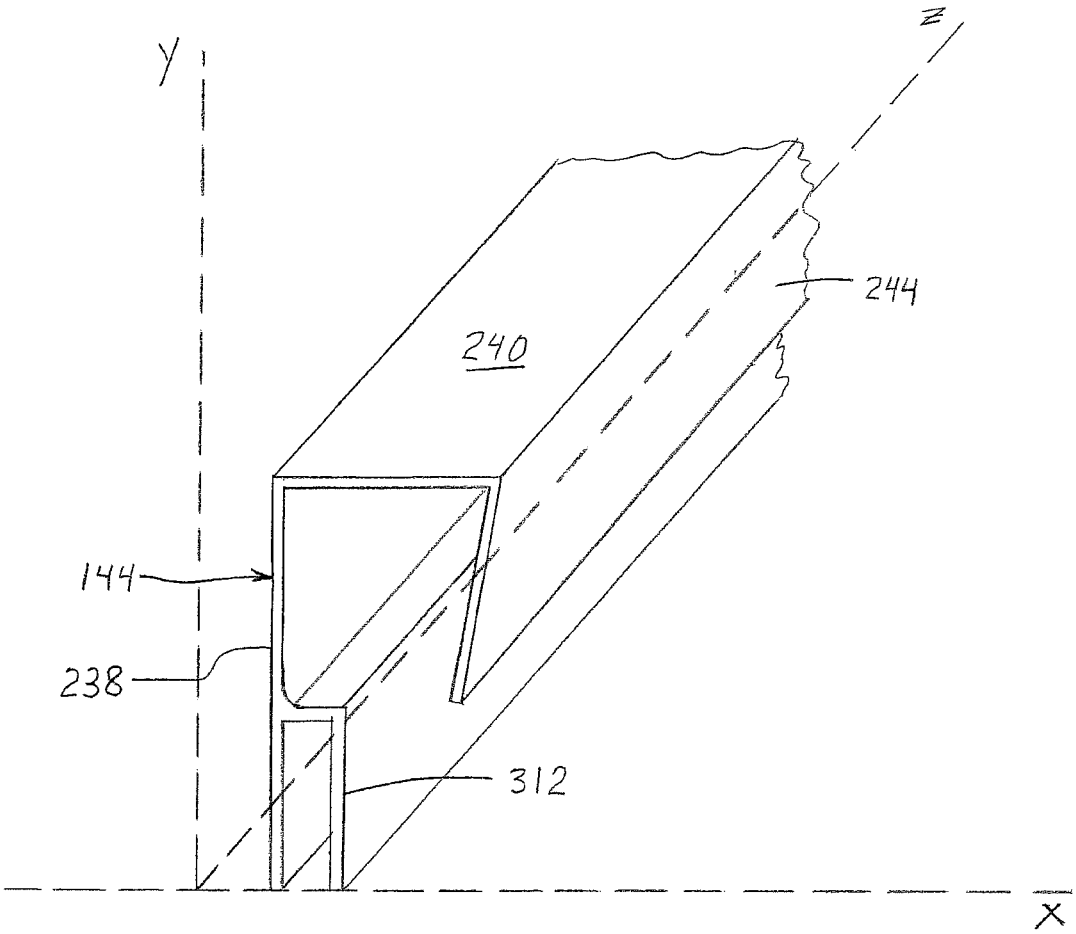
FIG. 19J is a pictorial view of the side rail shown in FIG. 19E, superposed on a three-dimensional x, y, z set of coordinates where the coordinates define an xy plane, an xz plane, and a yz plane, all perpendicular to each other, with the bottom of the upstanding web and the bottom of the cavity wall both residing in, and extending along, the xz plane, and the upstanding web being parallel to the yz plane.

The structure shown in FIG. 19I is similar to those illustrated in FIGS. 19A-19H in that it defines a cavity 314 which is lowered over standing seam 18. However, in the embodiments of FIG. 19I, the lower portion of the side rail is a mirror image of the embodiments of FIG. 19D while the upper portion of the structure is the same as in FIG. 19D except that inside panel 244 extends down at a perpendicular angle to bearing panel 240. Accordingly, the upstanding web 238 extends from a lower shoulder on the right side of the standing seam upwardly along the right side of the standing seam, to bearing panel 240, and thence to downwardly-depending inside panel 244. The cavity wall extends from a lower shoulder on the left side of the standing seam upwardly along the left side of the standing seam and across the top of the cavity to its joinder with web 238. TEK screws 320 extend through the cavity thus securing the side rail to the standing seam of the roof panels. An elongate block 326 of thermally insulating material, such as a block of 2-6 pcf polyethylene foam, is mounted in, optionally fills, rail cavity 264, thus providing thermal insulation along the height and length of the side rail. TEK screws 320 terminate in block 326 thus providing a thermal break between screws 320 and the space surrounded by load support structure 100. The building roof insulation 248 extends up through the aperture in the roof and the edge of the vapor barrier/facing sheet is captured by a series of screws spaced along the length of the side rail, which drive an elongate band 328 against the outer surface of inside panel 244 to capture and hold the edge of the vapor barrier, from which most of the insulation fiber has been removed. Thus, insulation 248 provides a vapor barrier between web 238 and the space surrounded by support structure 100.

FIG. 19I further shows a fragment of the skylight frame 132 overlying bearing flange 240 and secured to web 238 of the side rail using screws 300 spaced along the length of the side rail. Screws 300 terminate in insulation block 326 thus providing a thermal break between screws and the space surrounded by support structure 100.

The primary reason why the disclosed load support structures do not leak is that a great portion of the perimeter of the structure, namely that which is defined by side rails 142, 144, is above the panel flat, namely above the water line on the roof panel; and all associated roof penetrations, such as screws 310 which mount the rails to the ribs, are above the water line. With little or no standing water at the joints between the rails and the roof panels, even if the sealant fails at the joint, no substantial quantity of water routinely enters such failed joint because of the heights of those joints above the water line.

As a general statement, load support structures of the invention close off the roof aperture from unplanned leakage of e.g. air or water through the roof aperture. The load support structure 100 extends about the perimeter/sides of the roof aperture and extends from the roofing panel upwardly to the top opening in the load support structure. The lens subassembly overlies the top opening in the load support structure and thus closes off the top opening to complete the closure of the roof aperture.

Load support structure 140 has been illustrated in detail with respect to one or more variations of the standing seam roofs illustrated in FIGS. 1, 3, and 5. In light of such illustrations, those of skill in the art can now adapt the illustrated load support structures, by modifying, shaping of the structure elements, to support loads from any roof system which has a profile which includes elevations, above the panel flat, using standing joints or other raised elevations, such as, without limitation, those illustrated in FIGS. 2 and 4, as the locus of attachment to the roof.

Although the invention has been described with respect to various embodiments, this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A side rail for use in supporting an overlying load on a roof, wherein such roof comprises a plurality of metal roof panels which collectively define a plurality of elongate upstanding roof ribs, extending between an eave and a ridge of such roof as part of the roof, said roof ribs having roof rib tops, said side rail having first and second opposing side rail sides, and a length, and comprising:

(a) an upstanding elongate web, said upstanding web having a first top and a first bottom, a first length, and first side; and (b) an upstanding elongate cavity wall laterally displaced from, and extending alongside, said upstanding web, said cavity wall having a second length, and first and second opposing cavity wall sides, an upper portion of said cavity wall being connected to an intermediate portion of said upstanding web between the top and the bottom of said upstanding web, the combination of said upstanding cavity wall and said upstanding web defining a cavity between said upstanding web and said upstanding cavity wall, the cavity having a cavity top and a cavity bottom, and an elongate opening along the bottom of the cavity and proximate the bottoms of the upstanding web and the cavity wall, and wherein, when said side rail is viewed relative to x, y, and z coordinates, wherein the x, y, and z coordinates define an xy plane, an xz plane, and a yz plane, the xy plane, the xz plane, and the yz plane all being mutually perpendicular to each other, and when said upstanding web is upright, and the bottom of said upstanding web and the bottom of said upstanding cavity wall, at a given point along the length of said side rail, are at substantially equal elevations relative to the xz plane, said upstanding web is parallel to the yz plane.

2. A side rail as in claim 1 wherein said upstanding web and said upstanding wall are a single-piece element of said side rail, and meet at a location between the first top and the first bottom of said upstanding web, said upstanding web having a generally constant first cross-section base thickness between the first top and the first bottom of said upstanding web, said upstanding cavity wall comprising a cavity side wall and a cavity top wall, said cavity top wall having a generally constant second cross-section base thickness, and wherein, where said upstanding web and said upstanding cavity wall meet, said upstanding web has a thickness greater than the first cross-section thickness and said cavity wall has a thickness greater than the second cross-section thickness.

3. A side rail as in claim 2 wherein said side rail is an extruded metal side rail, including both said upstanding web and said upstanding wall.

4. A side rail as in claim 1 wherein said side rail is an extruded metal side rail, including both said upstanding web and said upstanding wall, said side rail being a load bearing structure which transfers such load to such roof.

5. A side rail as in claim 1 wherein a bottom-facing edge of said upstanding cavity wall, and the bottom of said upstanding web, both interface with the top of an underlying such roof rib, whereby both the bottom edge of said cavity wall and the bottom of said upstanding web transfer portions of such load to the top of such underlying roof rib.

6. A load support structure on a sloping metal roof of a building, such roof of such building comprising a plurality of elongate metal roof panels which collectively define a plurality of elongate upstanding roof ribs extending between a ridge and an eave of such building, such roof ribs having rib tops, said load support structure comprising (i) first and second side rail structures comprising at least first and second ones of said side rails as in claim 1 mounted on first and second ones of such upstanding ribs, said first and second side rail structures each having an up-slope end and a down-slope end, (ii) an upper diverter extending between the up-slope ends of said first and second side rail structures, and (iii) a lower closure extending between the down-slope ends of said first and second side rail structures, a bottom-facing edge of said upstanding cavity wall, and the bottom of said upstanding web, both interfacing with the top of an underlying such roof rib when said load support structure is mounted on such roof.

7. A sloping metal roof of a building, said roof comprising a plurality of elongate metal roof panels which collectively define a plurality of elongate upstanding roof ribs extending between a ridge and an eave of such building, said roof ribs having rib tops, a load support structure being mounted on said roof, said load support structure comprising (i) first and second side rail structures comprising at least first and second one of said side rails as in claim 1 mounted on first and second ones of such upstanding ribs and extending upwardly above said ribs, said first and second side rail structures each having an up-slope end and a down-slope end, (ii) an upper diverter extending between the up-slope ends of said first and second side rail structures, and (iii) a lower closure extending between the down-slope ends of said first and second side rail structures, a bottom-facing edge of said upstanding cavity wall, and the bottom of said upstanding web, both interfacing with the top of an underlying such roof rib.

8. A side rail for use in supporting an overlying load on a roof, said side rail having first and second opposing side rail sides, and a length, and comprising:

(a) an upstanding elongate web, said upstanding web having a first top and a first bottom; and (b) an upstanding elongate cavity wall laterally displaced from, and extending alongside, said upstanding web, said cavity wall having first and second opposing sides, said cavity wall being connected to said upstanding web, a cavity being defined between a first portion of said upstanding cavity wall and a first portion of said upstanding web, further comprising a lower shoulder extending away from at least one of said upstanding elongate web and said upstanding elongate cavity wall, a load bearing panel extending laterally from said upstanding web, at an angle substantially perpendicular to said upstanding web, and overlying an entirety of a width of the cavity from said upstanding web to said upstanding cavity wall.

9. A side rail as in claim 8, said lower shoulder extending away from the cavity, at an angle perpendicular to the upstanding web, at the bottom of the respective elongate web or cavity wall.

10. A side rail as in claim 9, said lower shoulder comprising a first shoulder panel extending at an angle from one of said upstanding web or said upstanding cavity wall, generally perpendicular to the respective one of said upstanding web or said upstanding cavity wall.

11. A side rail as in claim 9, said lower shoulder comprising a first lower shoulder, further comprising a second lower shoulder connected to said upstanding cavity wall at the bottom of the cavity, said first and second lower shoulders both extending transversely away from the cavity.

12. A side rail as in claim 11, said upstanding web and said first lower shoulder being defined in a first piece part and said upstanding wall and said second shoulder being defined in a second different piece part, said first and second piece parts being fastened to each other at an elevation at or above the top of such cavity by mechanical fasteners which extend through said upstanding web and said upstanding wall.

13. A sloping metal roof, said roof comprising a plurality of elongate roof panels which collectively define a plurality of elongate upstanding ribs, said ribs defining upstanding seams, a side rail as in claim 8 supporting an overlying load on said roof, a fastener extending through said upstanding web, through said upstanding wall, and through said upstanding seam.

14. A load support structure on a sloping metal roof of a building, such roof of such building comprising a plurality of elongate metal roof panels which collectively define a plurality of elongate upstanding roof ribs extending between a ridge and an eave of such building, such roof ribs having rib tops, said load support structure comprising (i) first and second side rail structures comprising at least first and second ones of said side rails as in claim 4 mounted on first and second ones of such upstanding ribs, said first and second side rail structures each having an up-slope end and a down-slope end, (ii) an upper diverter extending between the up-slope ends of said first and second side rail structures, and (iii) a lower closure extending between the down-slope ends of said first and second side rail structures, a bottom-facing edge of said upstanding cavity wall, and the bottom of said upstanding web, both interfacing with the top of an underlying such roof rib when said load support structure is mounted on such roof.

15. A sloping metal roof of a building, said roof comprising a plurality of elongate metal roof panels which collectively define a plurality of elongate upstanding ribs extending between a ridge and an eave of such building, said roof ribs having rib tops, a load support structure being mounted on said roof, said load support structure comprising (i) first and second side rail structures comprising at least first and second ones of said side rails as in claim 4 mounted on first and second ones of such upstanding ribs, said first and second side rail structures each having an up-slope end and a down-slope end, (ii) an upper diverter extending between the up-slope ends of said first and second side rail structures, and (iii) a lower closure extending between the down-slope ends of said first and second side rail structures, a bottom-facing edge of said upstanding cavity wall, and the bottom of said upstanding web, both interfacing with the top of an underlying such roof rib.

16. A side rail for use in supporting an overlying load on a roof, said side rail having first and second opposing side rail sides, and a length, and comprising:

(a) an upstanding elongate web, said upstanding web having a first top and a first bottom; and (b) an upstanding elongate cavity wall laterally displaced from, and extending alongside, said upstanding web, said cavity wall having first and second opposing sides, said cavity wall being connected to said upstanding web between the top and the bottom of said upstanding web, the combination of said upstanding cavity wall and said upstanding web defining a cavity between said upstanding web and said upstanding cavity wall, the cavity having a cavity top and a cavity bottom, and an elongate opening along the bottom of the cavity, a first lower shoulder being connected to said upstanding web and extending away from said upstanding web, a second lower shoulder being connected to said upstanding cavity wall, and extending away from said upstanding wall, and away from said first lower shoulder, said first lower shoulder comprising a first shoulder panel extending at an angle transverse to the respective upstanding wall or upstanding web, and a second shoulder panel connected to, and extending down from, said first shoulder panel to a distal end of the respective shoulder along a single direction which includes both a vertical vector and a horizontal vector.

17. A side rail as in claim 16, the second lower shoulder comprising a third shoulder panel connected to the other of said upstanding wall or said upstanding web, and extending away from, the first shoulder panel at an angle perpendicular to the respective upstanding web or upstanding wall, and a fourth shoulder panel connected to, and extending down from, said third shoulder panel to a distal end of the respective shoulder along a single direction which includes both a vertical vector and a horizontal vector.

18. A side rail as in claim 16, further comprising an upper load supporting flange extending away from said upstanding web at an angle transverse to said upstanding web.

19. A sloping metal roof on a building, said sloping metal roof comprising a plurality of elongate metal roof panels which collectively define a plurality of elongate upstanding ribs extending between a ridge and an eave of such building, said ribs defining upstanding seams extending upwardly above said ribs, said upstanding seams being defined by folded over first and second terminal edges of respective first and second adjacent roof panels, a load support structure being mounted on said roof for use in supporting an overlying load, said load support structure comprising (i) first and second side rails mounted on first and second ones of such upstanding ribs and extending upwardly above said ribs, each of said first and second side rails having a length, an up-slope end, and a down-slope end, and comprising an upstanding elongate web, said upstanding elongate web having a top and a bottom, an upstanding elongate cavity wall having a top and a bottom, and being laterally displaced from, and extending alongside, said upstanding web, said cavity wall being connected to said upstanding web, the combination of said upstanding cavity wall and said upstanding web defining a cavity between said upstanding web and said upstanding cavity wall, (ii) an upper diverter extending between the up-slope ends of said first and second side rails, and (iii) a lower closure extending between the down-slope ends of said first and second side rail structures, a space above the roof being surrounded by said load support structure, each of said first and second side rails further comprising an upper load-bearing flange extending away from the respective upstanding web and toward the other of said first and second side rails, and an inside web extending down from the respective said upper flange, thereby defining a second cavity between the respective said upstanding web and the respective said inside web, an elongate block of thermal insulation being disposed in the second cavity and extending from the respective said upper flange to the bottom of the respective said upstanding wall and wherein the respective said elongate block of thermal insulation is between the upstanding web of the respective said side rail and the space between said first and second side rails, further comprising a vapor barrier facing sheet extending up from under said roof and extending alongside said block of thermal insulation to an upper portion of the cavity.

20. A sloping metal roof as in claim 19, said load support structure extending about an aperture in said roof, further comprising a layer of thermally-insulating material underlying said sloping metal roof, said layer of thermally-insulating material extending up through the aperture and alongside the second cavity to an upper portion of the cavity.

21. A building as in claim 20, said thermally insulating material underlying said roof comprising roof insulation, edges of said roof insulation being held against an upper portion of a respective said side rail above said ribs wherein said roof insulation is disposed between said block of thermally insulating material and the space surrounded by said load support structure.

22. A sloping metal roof, said roof comprising a plurality of elongate roof panels which collectively define a plurality of elongate upstanding ribs, having top surfaces, upstanding seams extending upwardly above the top surfaces of said ribs, said upstanding seams being defined by folded over first and second terminal edges of respective first and second adjacent ones of said roof panels, a load support structure overlying a portion of said roof and comprising (i) first and second side rails mounted to first and second ones of said ribs and extending upwardly above said ribs, each said side rail comprising A. an upstanding elongate web having a top and a bottom, B. an upstanding elongate cavity wall laterally displaced from, and extending alongside, said upstanding web, said upstanding cavity wall being connected to said upstanding web, a cavity being defined between said upstanding web and said upstanding cavity wall, (ii) an upper diverter extending between the up-slope ends of said first and second side rails, and (iii) a lower closure extending between the down-slope ends of said first and second side rails, a fastener extending through said upstanding web, across the cavity, through said upstanding seam, and through said upstanding cavity wall.

23. A side rail for use in supporting an overlying load on a roof, said side rail having first and second opposing sides, and a length, and comprising:

(a) as a first piece part, an upstanding elongate web having a first top and a first bottom;

(b) as a second piece part, a cavity ridge comprising (i) a first upstanding cavity side wall, having a second top and a second bottom, and (ii) a second upstanding cavity side wall having first and second opposing cavity side wall sides and a first thickness between the first and second opposing cavity side wall sides, a third top and a third bottom, and being displaced from, and extending alongside, said first cavity side wall, said first and second upstanding cavity side walls being connected to each other at a top of said cavity ridge, thereby to define a cavity therebetween having a cavity top and a cavity bottom, and an elongate opening along the cavity bottom, a lower portion of said upstanding web extending alongside said second upstanding cavity side wall below the top of the cavity, an upper portion of said upstanding web extending upwardly above the top of the cavity.

24. A side rail as in claim 23 wherein, when said upstanding elongate web is in an upright orientation, the bottom of said upstanding web interfaces with a top surface of an underlying such rib and transfers at least a portion of such load to such roof.

25. A side rail for use in supporting an overlying load on a roof, said side rail having a length, and comprising:

(a) as a first piece part, an upstanding web having a first top and a first bottom;

(b) as a second piece part, an upstanding elongate cavity wall having a second top and a second bottom and a height between the second top and the second bottom, a lower portion of said cavity wall extending alongside, and being displaced from, said upstanding web, an upper portion of said cavity wall extending alongside, and proximate, said upstanding web, the combination of said upstanding cavity wall and said upstanding web defining a cavity between said upstanding web and said upstanding cavity wall, the cavity having a third top and a third bottom, and an elongate opening along the bottom of the cavity and proximate the bottom of the upstanding web, further comprising first and second lower shoulders connected to the bottoms of said upstanding web and said cavity wall, said first and second lower shoulders extending away from the cavity at respective first and second angles, to distal edges of the respective first and second lower shoulders, the first angle including a first horizontal vector and the second angle including a second horizontal vector opposing the first horizontal vector.

26. A side rail as in claim 25 wherein said lower shoulders each include a panel which extends along a single direction which includes both a vertical vector and a horizontal vector.

27. A side rail as in claim 25, further comprising a load bearing panel extending laterally from the top of one of said upstanding web and said cavity wall and overlying an entirety of a width of the cavity.

28. A side rail for use in supporting an overlying load on a roof, said side rail having first and second opposing sides, and a length, and comprising:

(a) as a first piece part, an upstanding elongate web having a first top and a first bottom;

(b) as a second piece part, a cavity ridge comprising (i) a first upstanding cavity wall element, having a second top and a second bottom, and (ii) a second upstanding cavity wall element having first and second opposing sides and a first thickness between the first and second opposing sides, a third top and a third bottom, and being displaced from, and extending alongside, said first cavity wall, a top of said cavity ridge connecting said first and second upstanding cavity walls to each other thereby to define a cavity therebetween having a cavity top and a cavity bottom, and an elongate opening along the cavity bottom, said upstanding web extending alongside said second cavity wall below the top of the cavity, said upstanding web further extending above the top of the cavity, further comprising a load bearing panel extending laterally from the top of said upstanding web and overlying an entirety of a width of the cavity from said first upstanding cavity wall to said second upstanding cavity wall.

29. A side rail for use in supporting an overlying load on a roof, wherein such roof comprises a plurality of metal roof panels which collectively define a plurality of elongate upstanding roof ribs, extending between an eave and a ridge of such roof as part of the roof, such roof ribs having roof rib tops, said side rail having first and second opposing side rail sides, and a length, and comprising:

(a) an upstanding elongate web, said upstanding web having a first top and a first bottom, a first length, and first side; and (b) an upstanding elongate cavity wall laterally displaced from, and extending alongside, said upstanding web, said cavity wall having a second length, and first and second opposing cavity wall sides, an upper portion of said cavity wall being connected to an intermediate portion of said upstanding web between the top and the bottom of said upstanding web, the combination of said upstanding cavity wall and said upstanding web defining a cavity between said upstanding web and said upstanding cavity wall, the cavity having a cavity top and a cavity bottom, and an elongate opening along the bottom of the cavity and proximate the bottoms of the upstanding web and the cavity wall, and wherein, when said side rail is viewed relative to x, y, and z coordinates, wherein the x, y, and z coordinates define an xy plane, an xz plane, and a yz plane, the xy plane, the xz plane, and the yz plane all being mutually perpendicular to each other, and wherein the bottom of said upstanding web and the bottom of said cavity wall both reside in, and extend along, the xz plane, said upstanding web is parallel to the yz plane.

* * * * *